US009522342B2

(12) United States Patent
Jazouli

(10) Patent No.: US 9,522,342 B2
(45) Date of Patent: Dec. 20, 2016

(54) DYNAMIC BLOCKS

(71) Applicant: Kidoy LLC, Waldorf, MD (US)

(72) Inventor: Taoufik Jazouli, Waldorf, MD (US)

(73) Assignee: KIDOY LLC, Waldorf, MD (US)

( * ) Notice: Subject to any disclaimer, the term of this patent is extended or adjusted under 35 U.S.C. 154(b) by 0 days.

(21) Appl. No.: 14/874,974

(22) Filed: Oct. 5, 2015

(65) Prior Publication Data

US 2016/0114255 A1 Apr. 28, 2016

Related U.S. Application Data

(60) Provisional application No. 62/068,680, filed on Oct. 25, 2014.

(51) Int. Cl.
*A63H 33/08* (2006.01)
*A63H 33/04* (2006.01)

(52) U.S. Cl.
CPC ..... *A63H 33/086* (2013.01); *A63H 33/042* (2013.01)

(58) Field of Classification Search
USPC ..... 446/102, 104, 108, 114, 115, 116, 120,446/121, 124, 125
See application file for complete search history.

(56) References Cited

U.S. PATENT DOCUMENTS

D224,029 S * 6/1972 Gale ..... 482/35
4,090,322 A * 5/1978 Hake ..... A63H 33/088 446/104
4,731,041 A * 3/1988 Ziegler ..... A63H 33/065 446/102
4,792,319 A * 12/1988 Svagerko ..... A63H 33/08 446/104
4,874,341 A * 10/1989 Ziegler ..... A63H 33/08 446/104
4,886,477 A * 12/1989 Ziegler ..... A63H 33/065 446/104
5,273,477 A * 12/1993 Adams, Jr. ..... A63H 33/08 446/108
5,501,626 A * 3/1996 Harvey ..... A63H 33/04 446/104
5,895,045 A * 4/1999 Vilar ..... A63H 33/06 273/160
6,142,848 A * 11/2000 Madner ..... A63H 33/04 446/107

(Continued)

OTHER PUBLICATIONS

Brik-A-Blok Set of 46 Red and Blue Panels. (n.d.). Retrieved Nov. 5, 2015, from http://www.amazon.com/Brik---Blok-Set-Blue-Panels/dp/B002NW5AG2/ref=sr_1_1?ie=UTF8&qid=1439846615&sr=8-1&keywords=Brik a Blok.

Plus-Plus 600-Piece Basic Assortment. (n.d.). Retrieved Nov. 5, 2015, from http://www.amazon.com/Plus-03310-Plus-Plus-600-Piece-Assortment/dp/B0080OJ6K8/ref=sr_1_2?ie=UTF8&qid=1439848548&sr=8-2&keywords=plus plus.

(Continued)

*Primary Examiner* — Kurt Fernstrom
(74) *Attorney, Agent, or Firm* — Cooley LLP

(57) ABSTRACT

Systems, apparatus, and methods related to dynamic blocks are described herein. In some embodiments, an apparatus includes a body, a first connector, and a second connector. The first connector and the second connector extend from the body and the second connector is spaced apart from the first connector. The first connector has a first side and second side and includes a first engagement feature on the first side. The second connector has a first side and a second side and includes a second engagement feature on the first side. The first side of the first connector faces the second side of the second connector.

28 Claims, 21 Drawing Sheets

(56) References Cited

U.S. PATENT DOCUMENTS

| | | | | |
|---|---|---|---|---|
| 6,186,855 | B1 * | 2/2001 | Bauer | A63H 33/04 446/104 |
| 6,464,553 | B2 * | 10/2002 | Huang | A63H 33/042 446/104 |
| 7,438,623 | B2 * | 10/2008 | Lin | A63H 33/086 446/104 |
| D645,912 | S * | 9/2011 | Hardstaff | D21/502 |
| 8,366,507 | B2 * | 2/2013 | Chen | A63H 33/086 446/108 |
| 2004/0214506 | A1 * | 10/2004 | Huang | A63H 33/04 446/85 |
| 2011/0294390 | A1 * | 12/2011 | Michalk | A63H 33/062 446/111 |

OTHER PUBLICATIONS

Battat Bristle Blocks 112-Piece Basic Building Set. (n.d.). Retrieved Nov. 5, 2015, from http://www.amazon.com/Battat-Bristle-Blocks-Basic-Building/dp/B00CEW9BV6/ref=sr__1__1?s=toys-and-games&ie=UTF8&qid=1439848615&sr=1-1&keywords=bristle blocks.

Learning Resources Mathlink Cubes-100. (n.d.). Retrieved Nov. 5, 2015, from http://www.amazon.com/Learning-Resources-LER4285-Mathlink-Cubes-100/dp/B000URL296/ref=sr__1__1?ie=UTF8&qid=1439848724&sr=8-1&keywords=connecting blocks.

Learning Resources Gears! Gears! Gears! Super Set. (n.d.). Retrieved Nov. 5, 2015, from http://www.amazon.com/Learning-Resources-Gears-Super-Set/dp/B00000JGWY/ref=sr__1.8?ie=UTF8&qid=1439848724&sr=8-8&keywords=connecting blocks.

* cited by examiner

DYNAMIC BLOCKS

CROSS-REFERENCE TO RELATED APPLICATIONS

This application claims priority to and the benefit of U.S. Provisional Application No. 62/068,680, filed Oct. 25, 2014 and entitled "Dynamic Blocks," the disclosure of which is hereby incorporated by reference in its entirety.

BACKGROUND

Embodiments described herein relate generally to toy construction blocks.

Children use construction toys to construct different forms and shapes. These construction toys are usually in the shape of blocks. Each block has the ability to interconnect to other blocks to form specific forms and shapes. Each block, however, is not necessarily capable of rotating or bending while interconnected to another block. Therefore the constructed form or shape, comprised of these blocks, is usually static and/or includes only a few customized parts that allow for movement.

There are two main limitations of this type of construction toys or blocks. The first limitation is that when using these blocks, children are not always capable of constructing dynamic structures that they can easily bend and/or rotate or otherwise manipulate. The second limitation is that the number of possible dynamic forms and shapes to be constructed is limited since the blocks are readily designed to interconnect at a specific angle and to primarily form static structures.

Therefore, a need exists for toy construction blocks that can rotate relative to each other and can interconnect at a variety of angles without easily separating, and without the need for customized parts to allow for dynamic movements of the resulting structure.

SUMMARY

Systems, apparatus, and methods related to dynamic blocks are described herein. In some embodiments, an apparatus includes a body, a first connector, and a second connector. The first connector and the second connector extend from the body and the second connector is spaced apart from the first connector. The first connector has a first side and second side and includes a first engagement feature on the first side. The second connector has a first side and a second side and includes a second engagement feature on the first side. The first side of the first connector faces the second side of the second connector.

DETAILED DESCRIPTION

The embodiments described herein relate to blocks which can be coupled in a variety of configurations and are rotatable relative to each other.

In some embodiments an apparatus includes a body, a first connector, and a second connector. The first connector and the second connector extend from the body and the second connector is spaced apart from the first connector. The first connector has a first side and second side and includes a first engagement feature on the first side. The second connector has a first side and a second side and includes a second engagement feature on the first side. The first side of the first connector faces the second side of the second connector.

In some embodiments a system includes a first block and a second block. The first block includes a first body and a first connector extending from the first body. The first connector has a first side and second side. The connector also includes a first engagement feature on the first side. The second block includes a second body, a second connector, and a third connector. The second connector and the third connector extend from the second body. The second connector has a first side and a second side. The third connector is spaced apart from the second connector. The third connector has a first side and a second side. The third connector also includes a second engagement feature on the first side. The second side of the second connector faces the first side of the third connector.

In some embodiments an apparatus includes a body, a first connector, and a second connector. The first connector and the second connector extend from the body. The first connector has a first side and a second side. The first connector includes a first engagement feature on the first side and a first flange on the second side. The second connector is spaced apart from the first connector. The second connector has a first side and a second side and includes a second engagement feature on the first side. The first side of the second connector faces the second side of the first connector.

As used herein, the singular forms "a," "an", and "the" include plural referents unless the context clearly dictates otherwise. Thus, for example, the term "a member" is intended to mean a single member or a combination of members; "a material" is intended to mean one or more materials, or a combination thereof.

As used herein, the term "substantially" is intended to mean within a range defined by traditional manufacturing tolerances.

Figure 1A:
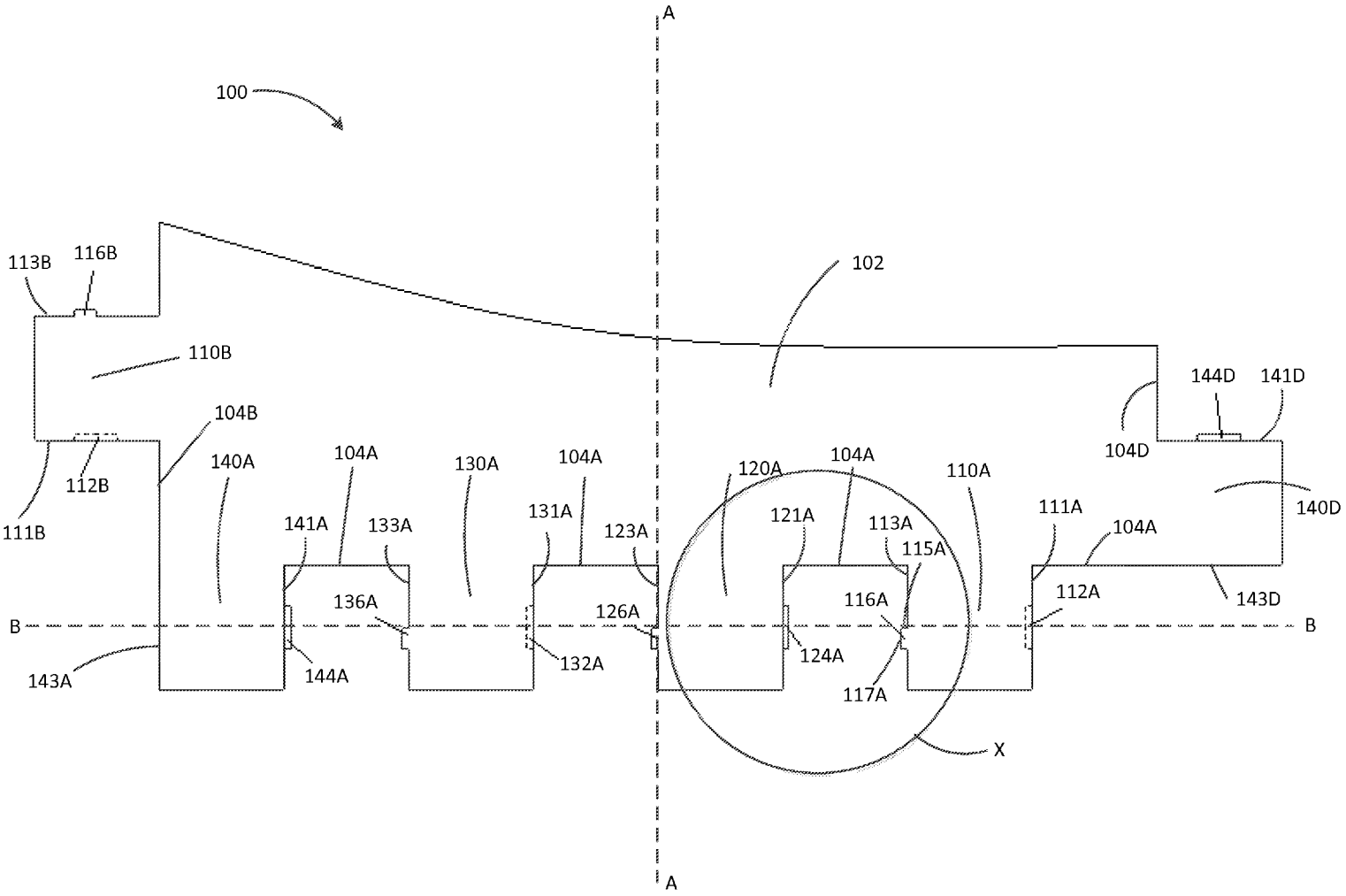
FIG. 1A is a schematic illustration of a portion of a block according to an embodiment.

FIG. 1A is a schematic illustration of a portion of a block 100 according to an embodiment. The block 100 includes a body 102. The body 102 includes a sidewall 104A. The block 100 includes a first connector 110A, a second connector 120A, a third connector 130A, and a fourth connector 140A. The first connector 110A, the second connector 120A, the third connector 130A, and the fourth connector 140A extend away from the sidewall 104A in a direction parallel to a centerline AA of the body 102.

Each of the connectors (110A, 120A, 130A, 140A) includes a first side and a second side. In particular, the first connector 110A includes a first side 111A and a second side 113A. The second connector 120A includes a first side 121A and a second side 123A. The third connector 130A includes a first side 131A and a second side 133A. The fourth connector 140A includes a first side 141A and a second side 143A. The second side 113A of the first connector 110A faces the first side 121A of the second connector 120A. Similarly, the second side 123A of the second connector 120A faces the first side 131A of the third connector 130A, and the second side 133A of the third connector 130A faces the first side 141A of the fourth connector 140A.

As shown in FIG. 1A, the first connector 110A and the third connector 130A are female connectors and include female engagement features. In other words, the first side 111A of the first connector 110A includes a first recess 112A and the first side 131A of the third connector 130A includes a second recess 132A. The second connector 120A and the fourth connector 140A are male connectors and include male engagement features. In other words, the first side 121A of the second connector 120A includes a first protrusion 124A and the first side 141A of the fourth connector 140A includes a second protrusion 144A. The first connector 110A, the second connector 120A, the third connector 130A, and the fourth connector 140A are arranged along the sidewall 104A such that the female connectors and male connectors alternate. Additionally, an axis BB extends through the first recess 112A, the first protrusion 124A, the second recess 132A, and the second protrusion 144A. In some implementations, the axis BB extends through the center of the first protrusion 124A and the second protrusion 144A. Although the first connector 110A and the third connector 130A are shown as being female connectors and the second connector 120A and the fourth connector 140A are shown as being male connectors, in some implementations the block 100 can be formed such that the first connector 110A and the third connector 130A are male connectors (i.e., include a protrusion instead of a recess) and the second connector 120A and the fourth connector 140A are female connectors (i.e., include a recess instead of a protrusion).

The first connector 110A, the second connector 120A, and the third connector 130A each include a flange. Specifically, a first flange 116A projects outwardly from the second side 113A of the first connector 110A. A second flange 126A projects outwardly from the second side 123A of the second connector 120A. A third flange 136A projects outwardly from the second side 133A of the third connector 130A. The second side 143A of the fourth connector 140A is a smooth, continuous side. Said another way, the second side 143A does not include an engagement feature or a flange.

Additionally, the block 100 includes a second sidewall 104B and a third sidewall 104D. As shown in FIG. 1A, a fifth connector 110B extends from the second sidewall 104B in a direction perpendicular to the centerline AA. Similarly to the first connector 110A, the fifth connector 110B includes a recess 112B on a first side 111B and a flange 116B on a second side 113B. The second side 143A of the fourth connector 140A and the second sidewall 104B of the body 102 have a smooth and continuous intersection. Said another way, the second side 143A of the fourth connector 140A and the second sidewall 104B of the body 102 lie in the same plane.

A sixth connector 140D extends from the third sidewall 104D in a direction perpendicular to the axis AA and opposite to the fifth connector 110B. Similarly to the fourth connector 140A, the sixth connector 140D includes a protrusion 144D on a first side 141D and a smooth, continuous second side 143D. Said another way, the second side 143D does not include an engagement feature or a flange. The second side 143D of the sixth connector 140D and the first sidewall 104A of the body 102 have a smooth and continuous intersection. Said another way, the second side 143D of the sixth connector 140D and the first sidewall 104A of the body 102 lie in the same plane.

As described above, the axis BB extends through the first recess 112A, the first protrusion 124A, the second recess 132A, and the second protrusion 144A of the first connector 110A, the second connector 120A, the third connector 130A, and the fourth connector 140A, respectively. Additionally, the axis BB lies in a plane (not shown) defined through the first connector 110A, the second connector 120A, the third connector 130A, and the fourth connector 140A. The plane lies perpendicular to the body 102. Said another way, the plane lies perpendicular to the centerline AA and parallel to the first sidewall 104A.

The first connector 110A, the second connector 120A, the third connector 130A, and the fourth connector 140A each extend a first distance from the body 102. The plane lies at a second distance from the body 102, the second distance being smaller than the first distance. In some implementations, the second distance is substantially half of the first distance. The body 102 lies on a first side of the plane, and the first flange 116A, the second flange 126A, and the third flange 136A lie on the second side of the plane. Each of the first flange 116A, the second flange 126A, and the third flange 136 have a bottom surface facing the first sidewall 104A of the body and a side surface substantially perpendicular to the bottom surface (i.e., each side surface lies in a plane perpendicular to the first sidewall 104A). For example, the first flange 116A has a bottom surface 115A and a side surface 117A. The bottom surface 115A faces the first sidewall 104A and lies in a plane parallel to the first sidewall 104A. The side surface 117A is perpendicular to the bottom surface 115A and to the first sidewall 104A. Although the first flange 116A, the second flange 126A, and the third flange 136A are shown as having flat side surfaces (e.g., side surface 117A), the side surfaces can also be shaped such that the surfaces are concave or convex.

The second side 123A of the second connector 120A extends along the centerline AA. The first side 131A of the third connector 130A is arranged along the first sidewall 104A such that the first side 131A is offset from the centerline AA. The first connector 110A, the second connector 120A, the third connector 130A, and the fourth connector 140A have widths taken along a line parallel to axis BB that are substantially equal. Additionally, the first connector 110A and the second connector 120A, the second connector 120A and the third connector 130A, and the third connector 130A and the fourth connector 140A are separated by a distance substantially equal to the width of one of the first connector 110A, the second connector 120A, the third connector 130A, and the fourth connector 140A. In other words, the distance of the space between each of the first connector 110A and the second connector 120A, the second connector 120A and the third connector 130A, and the third connector 130A and the fourth connector 140A is wide enough such that a connector of the same width as any of the first connector 110A, the second connector 120A, the third connector 130A, or the fourth connector 140A can be positioned between the first connector 110A and the second connector 120A, the second connector 120A and the third connector 130A, and the third connector 130A and the fourth connector 140A.

Figure 1B:
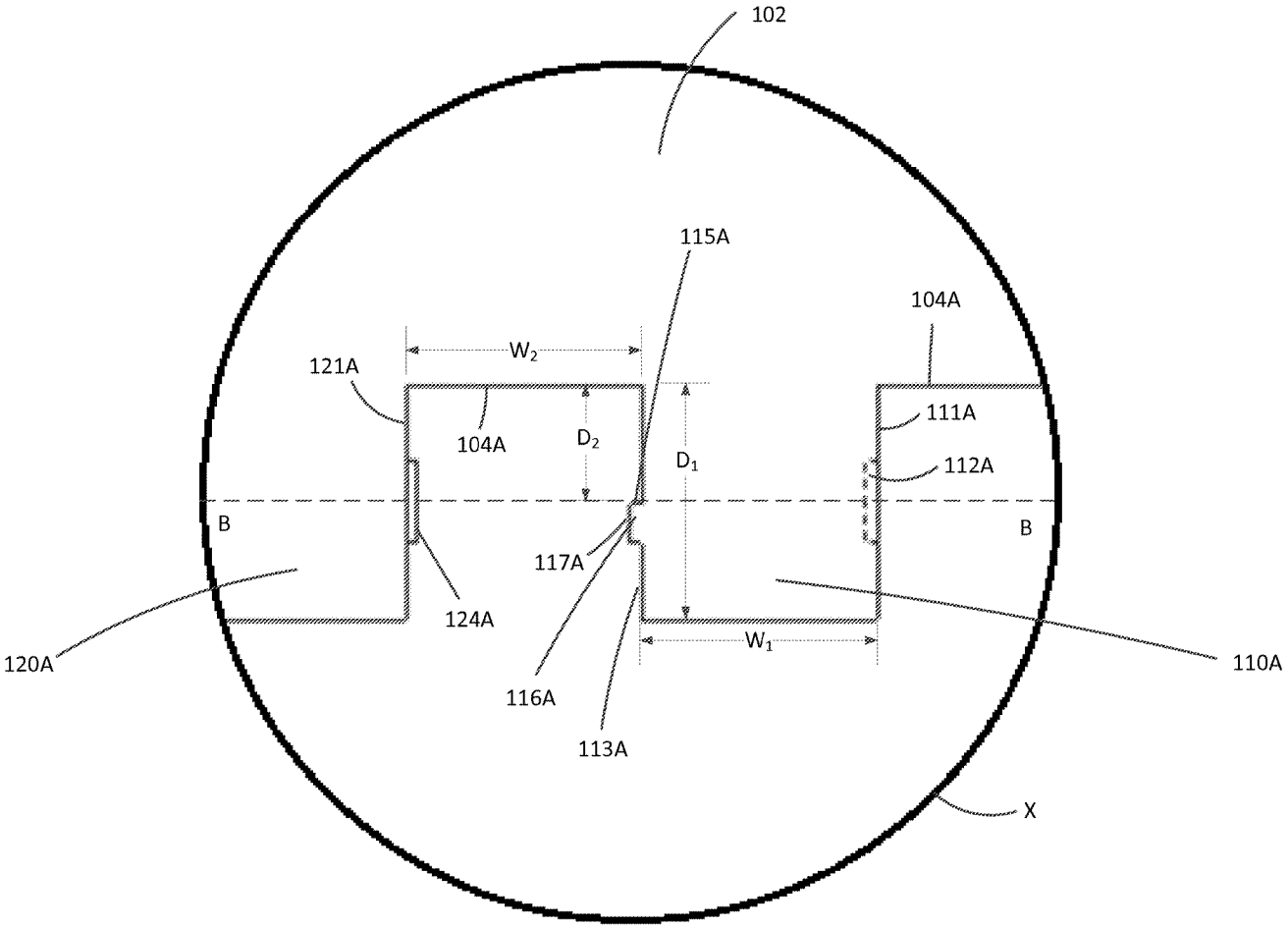
FIG. 1B is an enlarged view of the portion identified as region X in FIG. 1A.

For example, FIG. 1B is an enlarged view of the portion of the block 100 identified as region X in FIG. 1A. As shown in FIG. 1B, the first connector 110A has a first width $W_1$ and the space between the first connector 110A and the second connector 120A has a second width $W_2$. The first width $W_1$ and the second width $W_2$ are substantially equal. Additionally, as described above, the first connector 110A extends from the sidewall 104A of the body 102 a first distance $D_1$. The bottom surface 115A, and similarly the axis BB, lies a second distance $D_2$ from the first sidewall 104A of the body 102. Therefore, a plane containing the axis BB and the bottom surface 115A and lying parallel to the first sidewall 104A also lies a second distance $D_2$ from the first sidewall 104A. The second distance $D_2$ is smaller than the first distance $D_1$. In some implementations, the second distance $D_2$ is substantially half of the first distance $D_1$. In some implementations, the second distance $D_2$ is more than half of the first distance $D_1$.

In some alternative implementations, the first connector 110A, the second connector 120A, the third connector 130A, and/or the fourth connector 140A can have unequal widths. For example, the first connector 110A and the second connector 120A can have different widths. Similarly, in some implementations, first connector 110A and the second connector 120A, the second connector 120A and the third connector 130A, and/or the third connector 130A and the fourth connector 140A can be spaced apart by a distance equal to any of the widths of the first connector 110A, the second connector 120A, the third connector 130A, and the fourth connector 140A.

Although the block 100 is shown in FIG. 1 as including a first flange 116A, a second flange 126A, a third flange 136A, and a flange 116B, in some implementations the second side 113A, the second side 123A, the second side 133A, and the second side 113B can be smooth, continuous surfaces. Said another way, the second side 113A, the second side 123A, the second side 133A, and/or the second side 113B can be formed such that the second side 113A, the second side 123A, the second side 133A, and/or the second side 113B do not include an engagement feature or a flange.

Figure 2:
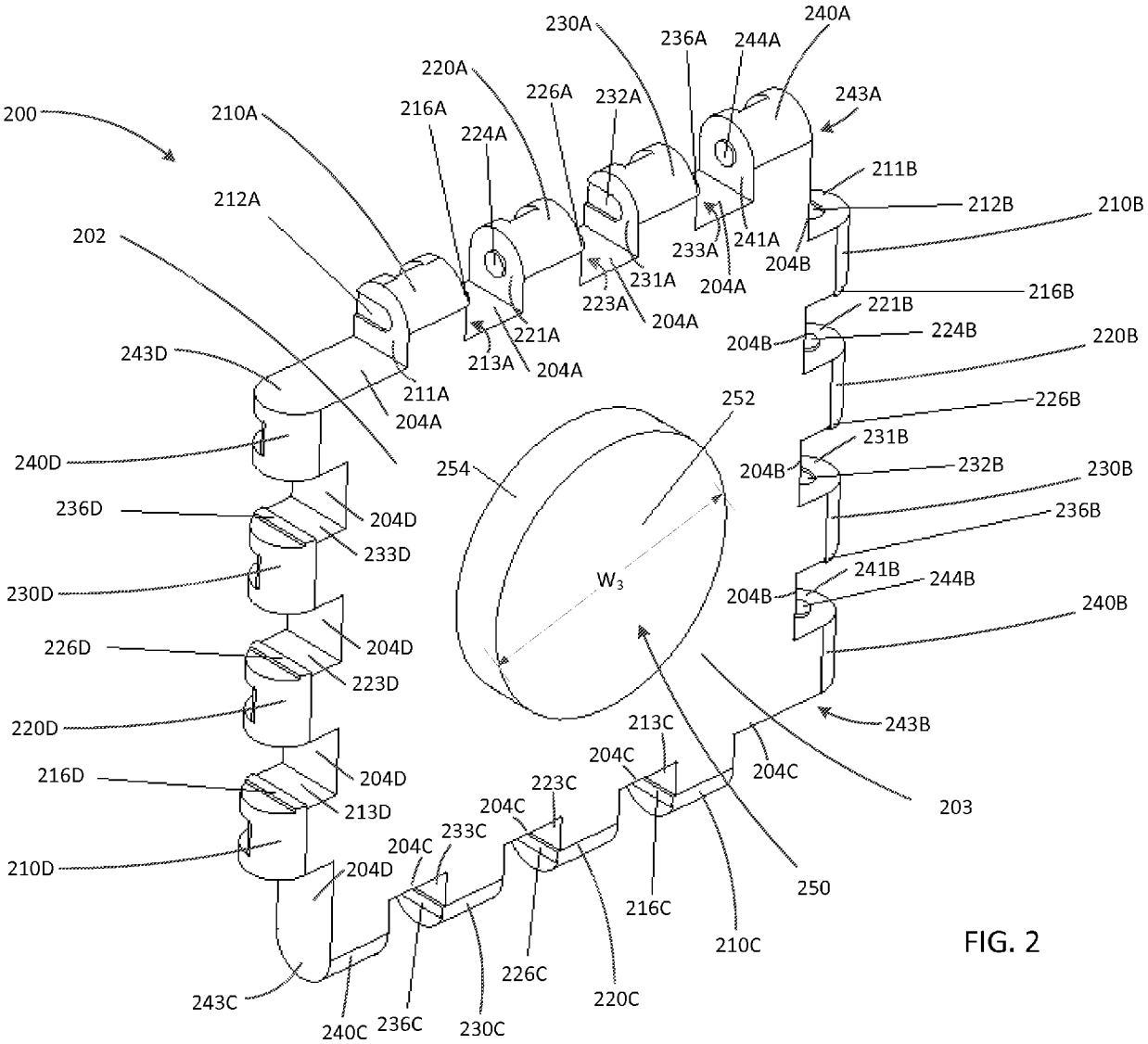
FIG. 2 is a front perspective view of a block according to an embodiment.
Figure 3:
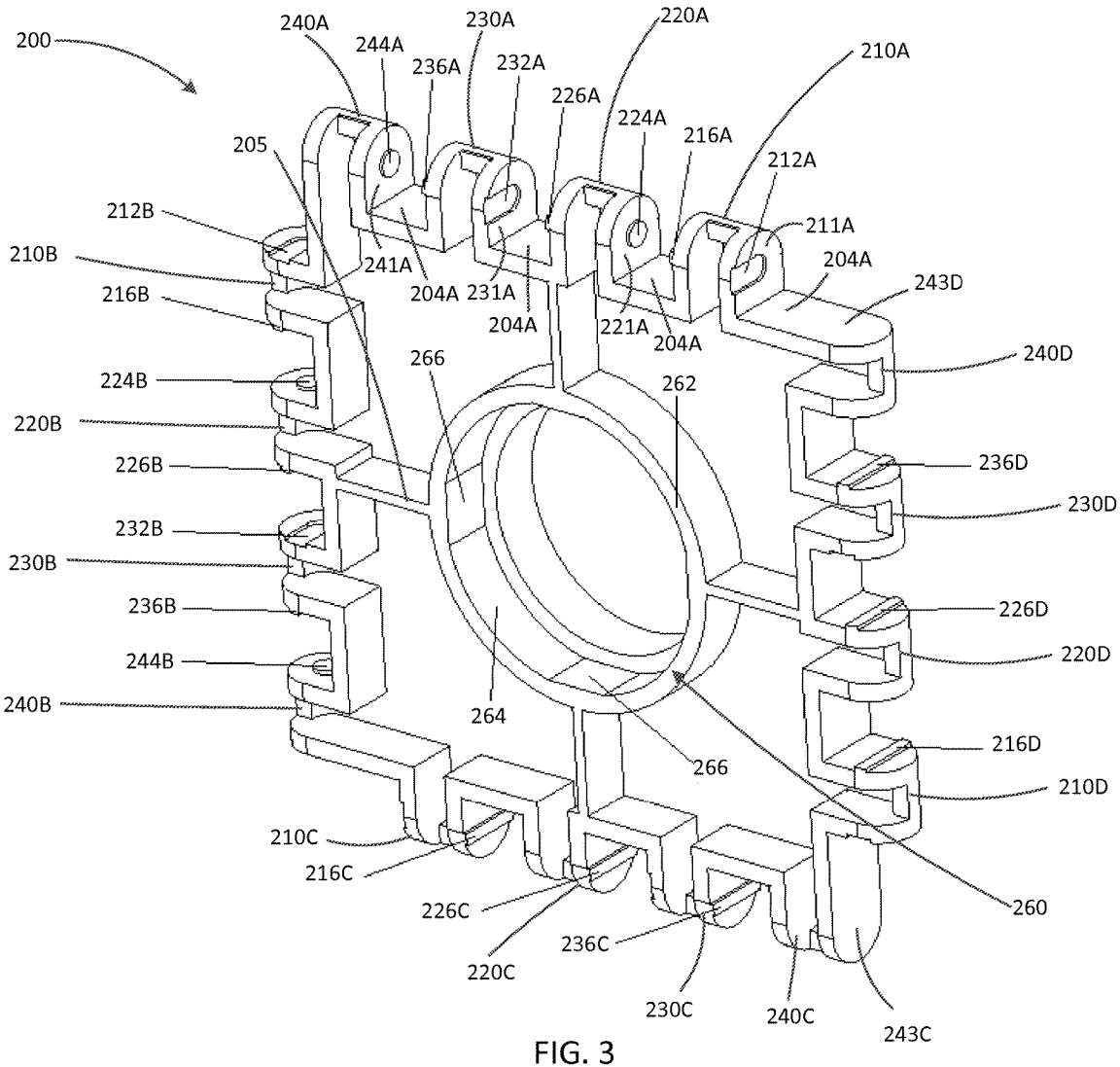
FIG. 3 is a rear perspective view of the block of FIG. 2.

FIGS. 2 and 3 are a front perspective view and a back perspective view, respectively, of a block 200 according to an embodiment. The block 200 has a first sidewall 204A, a second sidewall 204B, a third sidewall 204C, and a fourth sidewall 204D. The block 200 includes a first connector 210A, a second connector 220A, a third connector 230A, and a fourth connector 240A extending from the first sidewall 204A. Extending from the second sidewall 204B, the block 200 includes a fifth connector 210B, a sixth connector 220B, a seventh connector 230B, and an eighth connector 240B. Extending from the third sidewall 204C, the block 200 includes a ninth connector 210C, a tenth connector 220C, an eleventh connector 230C, and a twelfth connector 240C. Extending form the fourth sidewall 204D, the block 200 includes a thirteenth connector 210D, a fourteenth connector 220D, a fifteenth connector 230D, and a sixteenth connector 240D.

Similarly to the block 100 described above with respect to FIGS. 1A and 1B, each of the connectors of the block 200 includes a first side and a second side. For example, with respect to the connectors extending from the first sidewall 204A, the first connector 210A includes a first side 211A and a second side indicated at 213A. The second connector 220A includes a first side 221A and a second side indicated at 223A. The third connector 230A includes a first side 231A and a second side indicated at 233A. The fourth connector 240A includes a first side 241A and a second side indicated at 243A. The second side 213A of the first connector 210A faces the first side 221A of the second connector 220A. Similarly, the second side 223A of the second connector 220A faces the first side 231A of the third connector 230A, and the second side 233A of the third connector 230A faces the first side 241A of the fourth connector 240A.

Similarly to the connectors extending from the first sidewall 204A, the connectors extending from the second sidewall 204B also include a first side and a second side. Specifically, the fifth connector 210B includes a first side 211B and a second side (not shown). The sixth connector 220B includes a first side 221B and a second side (not shown). The seventh connector 230B includes a first side 231B and a second side (not shown). The eighth connector 240B includes a first side 241B and a second side indicated at 243B.

Also similarly to the connectors extending from the first sidewall 204A, the connectors extending from the third sidewall 204C also include a first side and a second side. Specifically, the ninth connector 210C includes a first side (not shown) and a second side 213C. The tenth connector 220C includes a first side (not shown) and a second side 223C. The eleventh connector 230C includes a first side (not shown) and a second side 233C. The twelfth connector 240C includes a first side (not shown) and a second side 243C.

Additionally, similarly to the connectors extending from the other sidewalls (204A, 204B, 204C), the connectors extending from the fourth sidewall 204D include a first side and a second side. Specifically, the thirteenth connector 210D includes a first side (not shown) and a second side 213D. The fourteenth connector 220D includes a first side (not shown) and a second side 223D. The fifteenth connector 230D includes a first side (not shown) and a second side 233D. The sixteenth connector 240D includes a first side (not shown) and a second side 243D.

Similarly to block 100 described with respect to FIG. 1, the connectors of the block 200 are arranged such that female and male connectors alternate along the sidewalls of the block 200. The first and third connectors on each side (i.e., connectors 210A, 230A, 210B, 230B, 210C, 230C, 210D, and 230D) are female connectors. For example, the female connectors 210A, 230A, 210B, and 230B include recesses 212A, 232A, 212B, and 232B, respectively. Although not shown in FIGS. 2 and 3, the female connectors 210C, 230C, 210D, and 230D also include recesses. The recesses 212A, 232A, 212B, and 232B are located on the first side of each of the connectors 210A, 230A, 210B, and 230B, respectively. For example, as shown in FIG. 2, the recess 212A is located on the first side 211A of the connector 210A, the recess 232A is located on the first side 231A of the connector 230A, the recess 212B is located on the first side 211B of the connector 210B, and the recess 232B is located on the first side 231B of the connector 230B. Although not shown, the recesses of female connectors 210C, 230C, 210D, and 230D are also located on the first side of each of the connectors 210C, 230C, 210D, and 230D.

In contrast, the second and fourth connectors on each side (i.e., connectors 220A, 240A, 220B, 240B, 220C, 240C, 220D, and 240D) are male connectors. For example, the male connectors 220A, 240A, 220B, and 240B include protrusions 224A, 244A, 224B, and 244B, respectively. Although not shown in FIGS. 2 and 3, the male connectors 220C, 240C, 220D, and 240D also include protrusions. The protrusions 224A, 244A, 224B, and 244B are located on the first side of each of the connectors 210A, 230A, 210B, and 230B, respectively. For example, as shown in FIG. 2, the protrusion 224A is located on the first side 221A of the connector 220A, the protrusion 244A is located on the first side 241A of the connector 240A, the protrusion 224B is located on the first side 221B of the connector 220B, and the protrusion 244B is located on the first side 241B of the connector 240B. Although not shown, the protrusions of the male connectors 220C, 240C, 220D, and 240D are also located on the first side of each of the connectors 220C, 240C, 220D, and 240D.

As shown in FIGS. 2 and 3, the connectors 210A, 220A, and 230A each include a flange 216A, 226A, and 236A, respectively. The flanges project outwardly from the second side of each connector. For example, the flange 216A projects outwardly from the second side 213A of the first connector 210A. The flange 226A projects outwardly from the second side 223A of the second connector 220A. The flange 236A projects outwardly from the second side 233A of the third connector 230A. Similarly, flanges 216B, 226B, and 236B project outwardly from the second sides of each of the connectors 210B, 220B, and 230B, respectively. Similarly, as shown in FIGS. 2 and 3, the flanges 216C, 226C, and 236C project outwardly from the second sides 213C, 223C, and 233C of each of the connectors 210C, 220C, and 230C, respectively. Similarly, flanges 216D, 226D, and 236D project outwardly from the second sides 213D, 223D, and 233D of each of the connectors 210D, 220D, and 230D, respectively. Each flange of the block 200 is similar in structure and function to the first flange 116A, the second flange 126A, and the third flange 136A described above with reference to block 100 and will not be further described herein.

The second sides (i.e., 243A, 243B, 243C, and 243D) of the connectors 240A, 240B, 240C, and 240D are each a smooth, continuous surface. Said another way, the second sides (i.e., 243A, 243B, 243C, and 243D) of the connectors 240A, 240B, 240C, and 240D do not include an engagement feature or a flange. Additionally, the second sides (i.e., 243A, 243B, 243C, and 243D) of the connectors 240A, 240B, 240C, and 240D each have a smooth and continuous intersection with their respective adjacent sidewalls. Said another way, the second sides (i.e., 243A, 243B, 243C, and 243D) of the connectors 240A, 240B, 240C, and 240D each lie in the same plane as their respective adjacent sidewalls. For example, the second side 243A of the fourth connector 240A and the second sidewall 204B of the body 202 lie in the same plane and have a smooth and continuous intersection. The second side 243B of the eighth connector 240B and the third sidewall 204C of the body 202 lie in the same plane and have a smooth and continuous intersection. The second side 243C of the twelfth connector 240C and the fourth sidewall 204D of the body 202 lie in the same plane and have a smooth and continuous intersection. The second side 243D of the fourth connector 240D and the first sidewall 204A of the body 202 lie in the same plane and have a smooth and continuous intersection.

The four connectors extending from and in combination with each sidewall (i.e., 204A, 204B, 204C, 204D) are substantially similar in structure and function as the first connector 110A, the second connector 120A, the third connector 130A, and the fourth connector 140A in combination with sidewall 104A described above with reference to FIGS. 1A and 1B. Therefore, the connectors of the block 200 will not be further described herein.

The body 202 of the block 200 includes a front face, or first face, 203. A raised portion 250 extends from the front face 203. The raised portion 250 includes an engaging sidewall 252 and an engaging face 254. The engaging face 254 has a width $W_3$. Although the raised portion 250 is shown as a cylinder having a circular engaging face 254, the raised portion 250 can be any suitable shape and/or size. For example, the engaging face 254 can be triangular or square. Additionally, although the engaging sidewall 252 is shown as being perpendicular to the front face 203 and the engaging face 254, the engaging sidewall 252 can be formed at any suitable angle to the front face 203 and the engaging face 254.

Additionally, although the sidewalls 204A, 204B, 204C, and 204D are shown as being flat and substantially perpendicular to the front face 203 of the block 200, the sidewalls 204A, 204B, 204C, and 204D can be formed such that the edges are curved or sloped. In other words, the sidewalls 204A, 204B, 204C, and 204D can be formed such that the transition from the sidewall face to the front face 203 is curved or has a constant slope.

As shown in FIG. 3, the block 200 has a second face, or back face, 205. The second face 205 includes a mating portion 260. The mating portion includes a sidewall 262. The sidewall 262 includes an inner surface 264 that defines a cavity. The inner surface 264 includes protuberances 266. The protuberances 266 extend into the cavity and cause the inner surface 264 of the mating portion 260 to be discontinuous. Although the block 200 is shown as including four protuberances 266, the block 200 can include any suitable number of protuberances. Additionally, although the protuberances 266 are shown as being shaped as convex extensions, the protuberances 266 can be formed in any suitable shape or size.

Figure 4:
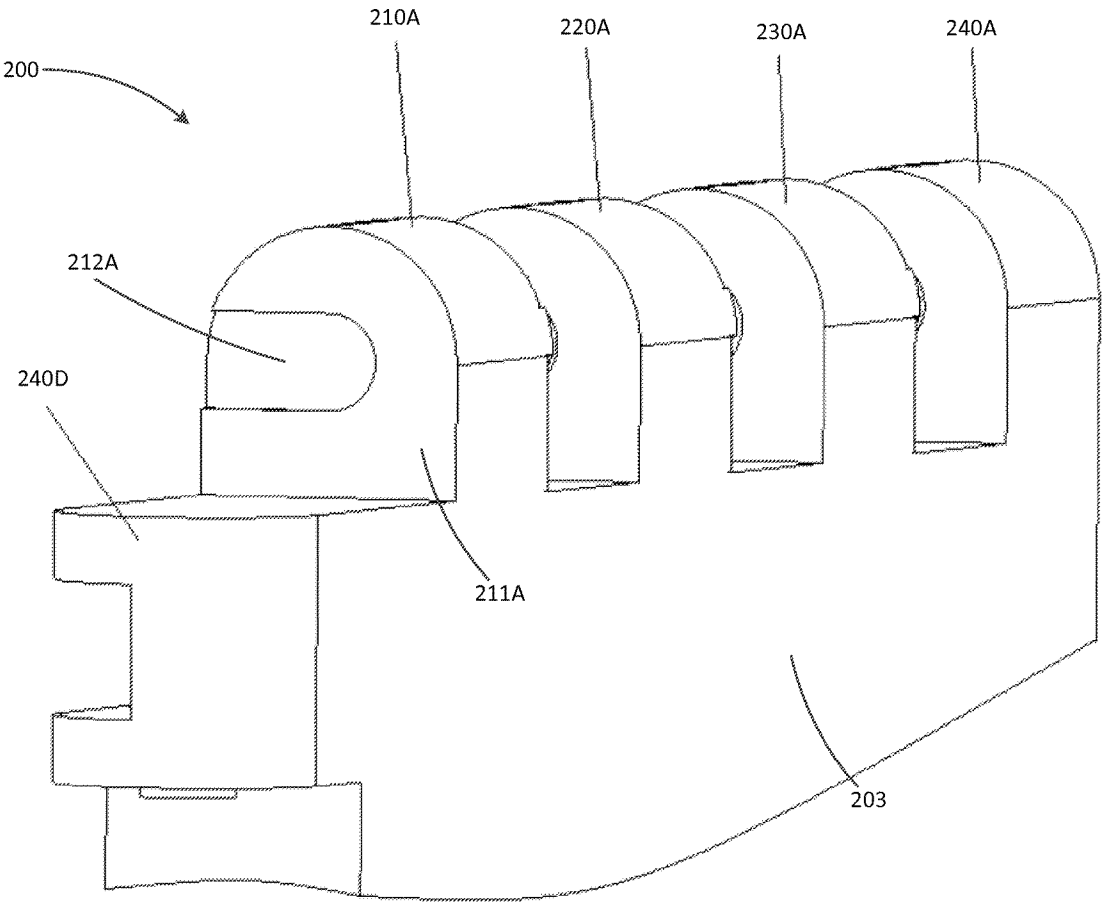
FIG. 4 is a perspective view of a portion of the block of FIG. 2.

FIG. 4 is a perspective view of a portion of the block 200. As shown in FIG. 4 (and previously in FIGS. 2 and 3), the connectors extending from the block 200 each include a half cylinder shaped end portion. In other words, the first and second sides of each connector are shaped as a "U". Additionally, the recesses formed in the female connectors of the block 200 extend to an edge of each respective connector. For example, the recess 212A in the first face 211A of the first connector 210A extends away from a plane containing the front face 203 of the block 200. In other words, the recess 212A extends from an axis of the connector 210A (similar to axis BB shown in FIGS. 1A and 1B) toward a back surface of the block 200. Additionally, the recess 212A is U-shaped. In some implementations, however, although shown as being U-shaped, the recess 212A can be any suitable shape. Each of the recesses of the block 200 described above and shown in FIGS. 2-4 are similar in structure and function to the recess 212A of the first connector 210A and will not be further described herein.

Figure 5:
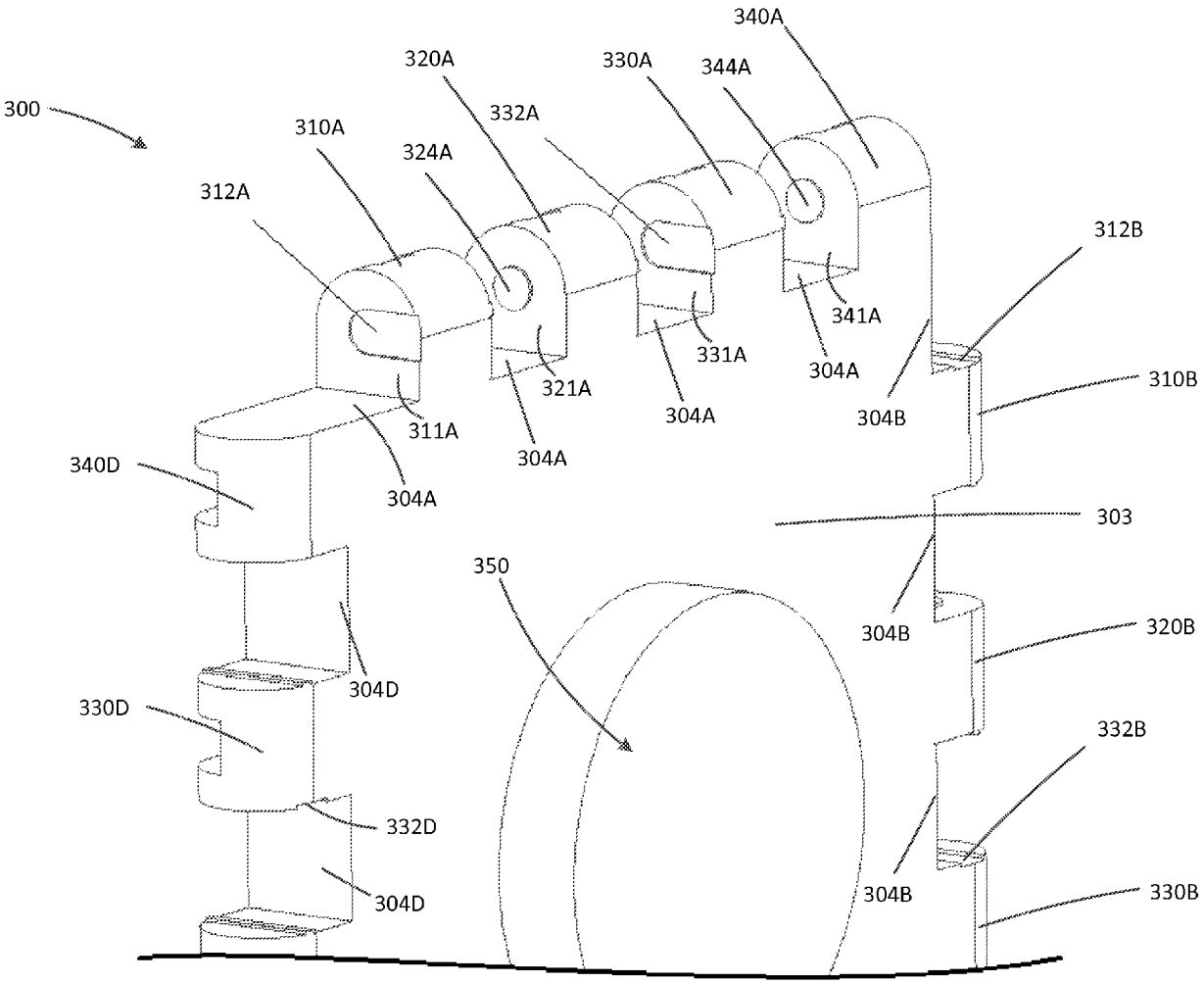
FIG. 5 is a perspective view of a portion of a block according to an embodiment.

Although the recesses are shown as extending away from a plane containing the front face 203 of the block 200, in some implementations the recesses can extend toward a plane containing the front face 203 of the block 200. For example, FIG. 5 shows a portion of a block 300 according to an embodiment. Similar to the block 200 described above with reference to FIGS. 2-4, the block 300 includes a first sidewall 304A. The block 300 includes a first connector 310A, a second connector 320A, a third connector 330A, and a fourth connector 340A extending from the first sidewall 304A. Similar to the block 200, each of the connectors of the block 300 include a first side and a second side. For example, with respect to the connectors extending from the first sidewall 304A, the first connector 310A includes a first side 311A and a second side (not shown). The second connector 320A includes a first side 321A and a second side (not shown). The third connector 330A includes a first side 331A and a second side (not shown). The fourth connector 340A includes a first side 341A and a second side (not shown). The second side of the first connector 310A faces the first side 321A of the second connector 320A. Similarly, the second side of the second connector 320A faces the first side 331A of the third connector 330A, and the second side of the third connector 330A faces the first side 341A of the fourth connector 340A.

The block 300 includes a raised portion 350. The portion of the block 300 shown in FIG. 5 also shows that the block 300 includes a second sidewall 304B and a fourth sidewall 304D. The block 300 includes connectors 310B, 320B, and 330B extending from the second sidewall 304B and connectors 330D and 340D extending from the fourth sidewall 304D. With the exception of the orientation of the recesses 312A, 332A, 312B, 332B, 332D, the other recesses not shown in the female connectors 310A, 330A, 310B, 330B, 330D, and others recesses not shown in FIG. 5, the block 300 is similar in structure and function to the block 200 described above with reference to FIGS. 2-4 and will not be further described herein. With respect to the recesses 312A, 332A, 312B, 332B, 332D, the recesses extend toward a plane containing the face 303 of the block 300.

Figure 6:
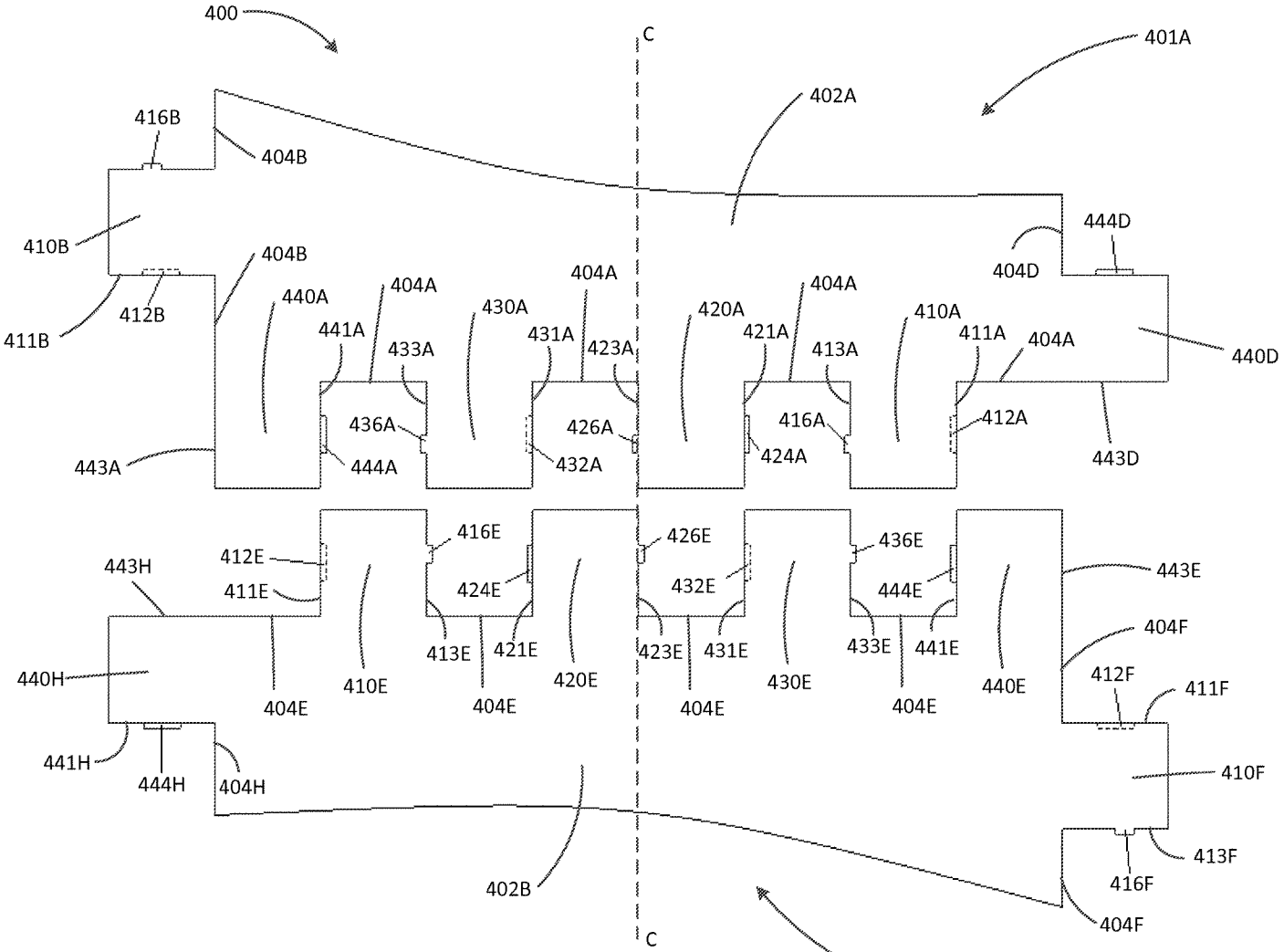
FIG. 6 is a schematic illustration of a system according to an embodiment in a disengaged configuration.

FIG. 6 is a schematic illustration of a system 400 in a disengaged configuration. The system 400 includes a first block 401A and a second block 401B. The first block 401A and the second block 401B are substantially identical in shape to each other and to the block 100 described above with reference to FIG. 1. The first block 401A and the second block 401B share a centerline CC in this disengaged configuration.

The first block 401A includes a body 402A. The body 402A includes a sidewall 404A. The block 401A includes a first connector 410A, a second connector 420A, a third connector 430A, and a fourth connector 440A. The first connector 410A, the second connector 420A, the third connector 430A, and the fourth connector 440A extend away from the sidewall 404A in a direction parallel to the centerline CC of the first block 401A.

Each of the connectors (410A, 420A, 430A, 440A) includes a first side and a second side. In particular, the first connector 410A includes a first side 411A and a second side 413A. The second connector 420A includes a first side 421A and a second side 423A. The third connector 430A includes a first side 431A and a second side 433A. The fourth connector 440A includes a first side 441A and a second side 443A. The second side 413A of the first connector 410A faces the first side 421A of the second connector 420A. Similarly, the second side 423A of the second connector 420A faces the first side 431A of the third connector 430A, and the second side 433A of the third connector 430A faces the first side 441A of the fourth connector 440A.

The first connector 410A and the third connector 430A are female connectors and include female engagement features. In other words, the first side 411A of the first connector 410A includes a first recess 412A and the first side 431A of the third connector 430A includes a second recess 432A. The second connector 420A and the fourth connector 440A are male connectors and include male engagement features. In other words, the first side 421A of the second connector 420A includes a first protrusion 424A and the first side 441A of the fourth connector 440A includes a second protrusion 444A. The first connector 410A, the second connector 420A, the third connector 430A, and the fourth connector 440A are arranged along the sidewall 404A such that the female connectors and male connectors alternate. Although the first connector 410A and the third connector 430A are shown as being female connectors and the second connector 420A and the fourth connector 440A are shown as being male connectors, in some implementations the block 400 can be formed such that the first connector 410A and the third connector 430A are male connectors (i.e., include a protrusion instead of a recess) and the second connector 420A and the fourth connector 440A are female connectors (i.e., include a recess instead of a protrusion).

The first connector 410A, the second connector 420A, and the third connector 430A each include a flange. Specifically, a first flange 416A projects outwardly from the second side 413A of the first connector 410A. A second flange 426A projects outwardly from the second side 423A of the second connector 420A. A third flange 436A projects outwardly from the second side 433A of the third connector 430A. The first flange 416A, the second flange 426A, and the third flange 436A each include a bottom surface similar to the bottom surface 115A of the flange 116A in FIG. 1A and a side surface similar to the side surface 117A of the flange 116A. The second side 443A of the fourth connector 440A is a smooth, continuous side. Said another way, the second side 443A does not include an engagement feature or a flange.

Additionally, the block 400 includes a second sidewall 404B and a third sidewall 404D. As shown in FIG. 4, a fifth connector 410B extends from the second sidewall 404B in a direction perpendicular to the centerline CC. Similarly to the first connector 410A, the fifth connector 410B includes a recess 412B on a first side 411B and a flange 416B on a second side 413B. The second side 443A of the fourth connector 440A and the second sidewall 404B of the body 402 have a smooth and continuous intersection. Said another way, the second side 443A of the fourth connector 440A and the second sidewall 404B of the body 402 lie in the same plane.

A sixth connector 440D extends from the third sidewall 404D in a direction perpendicular to the axis CC and opposite to the fifth connector 410B. Similarly to the fourth connector 440A, the sixth connector 440D includes a protrusion 444D on a first side 441D and a smooth, continuous second side 443D. Said another way, the second side 443D does not include an engagement feature or a flange. The second side 443D of the sixth connector 440D and the first sidewall 404A of the body 402 have a smooth and continuous intersection. Said another way, the second side 443D of the sixth connector 440D and the first sidewall 404A of the body 402 lie in the same plane.

The second block 401B includes a body 402B. The body 402B includes a sidewall 404E. The block 401B includes a first connector 410E, a second connector 420E, a third connector 430E, and a fourth connector 440E. The first connector 410E, the second connector 420E, the third connector 430E, and the fourth connector 440E extend away from the sidewall 404E in a direction parallel to the centerline CC of the first block 401B.

Each of the connectors (410E, 420E, 430E, 440E) includes a first side and a second side. In particular, the first connector 410E includes a first side 411E and a second side 413E. The second connector 420E includes a first side 421E and a second side 423E. The third connector 430E includes a first side 431E and a second side 433E. The fourth connector 440E includes a first side 441E and a second side 443E. The second side 413E of the first connector 410E faces the first side 421E of the second connector 420E. Similarly, the second side 423E of the second connector 420E faces the first side 431E of the third connector 430E, and the second side 433E of the third connector 430E faces the first side 441E of the fourth connector 440E.

The first connector 410E and the third connector 430E are female connectors and include female engagement features. In other words, the first side 411E of the first connector 410E includes a first recess 412E and the first side 431E of the third connector 430E includes a second recess 432E. The second connector 420E and the fourth connector 440E are male connectors and include male engagement features. In other words, the first side 421E of the second connector 420E includes a first protrusion 424E and the first side 441E of the fourth connector 440E includes a second protrusion 444E. The first connector 410E, the second connector 420E, the third connector 430E, and the fourth connector 440E are arranged along the sidewall 404E such that the female connectors and male connectors alternate. Although the first connector 410E and the third connector 430E are shown as being female connectors and the second connector 420E and the fourth connector 440E are shown as being male connectors, in some implementations the block 401B can be formed such that the first connector 410E and the third connector 430E are male connectors (i.e., include a protrusion instead of a recess) and the second connector 420E and the fourth connector 440E are female connectors (i.e., include a recess instead of a protrusion).

The first connector 410E, the second connector 420E, and the third connector 430E each include a flange. Specifically, a first flange 416E projects outwardly from the second side 413E of the first connector 410E. A second flange 426E projects outwardly from the second side 423E of the second connector 420E. A third flange 436E projects outwardly from the second side 433E of the third connector 430E. The first flange 416E, the second flange 426E, and the third flange 436E each include a bottom surface similar to the bottom surface 115A of the flange 116A in FIG. 1A and a side surface similar to the side surface 117A of the flange 116A. The second side 443E of the fourth connector 440E is a smooth, continuous side. Said another way, the second side 443E does not include an engagement feature or a flange.

Additionally, the block 401B includes a second sidewall 404F and a third sidewall 404H. As shown in FIG. 6, a fifth connector 410F extends from the second sidewall 404F in a direction perpendicular to the centerline CC. Similarly to the first connector 410E, the fifth connector 410F includes a recess 412F on a first side 411F and a flange 416F on a second side 413F. The second side 443E of the fourth connector 440E and the second sidewall 404F of the body 402B have a smooth and continuous intersection. Said another way, the second side 443E of the fourth connector 440E and the second sidewall 404F of the body 402B lie in the same plane.

A sixth connector 440H extends from the third sidewall 404H in a direction perpendicular to the axis CC and opposite to the fifth connector 410F. Similarly to the fourth connector 440E, the sixth connector 440H includes a protrusion 444H on a first side 441H and a smooth, continuous second side 443H. Said another way, the second side 443H does not include an engagement feature or a flange. The second side 443H of the sixth connector 440H and the first sidewall 404E of the body 402B have a smooth and continuous intersection. Said another way, the second side 443H of the sixth connector 440H and the first sidewall 404E of the body 402B lie in the same plane.

The elements of the first block 401A and the second block 401B are substantially identical in structure and function to the block 100 described with reference to FIGS. 1A and 1B above and will not be further described herein. Additionally, similarly as described above with reference to block 100, the spacing between each adjacent connector is substantially equal to the width of an individual connector such that the connectors of the first block 401A can engaged with the connectors of the second block 401B by being positioned in an interlocking arrangement. In other words, the connectors are spaced such that the connector 410E can be positioned between connectors 430A and 440A, the connector 420E can be positioned between connectors 420A and 430A, and the connector 430E can be positioned between connectors 410A and 420A. Additionally, the connector 410A can be positioned between connectors 440E and 430E.

Figure 7:
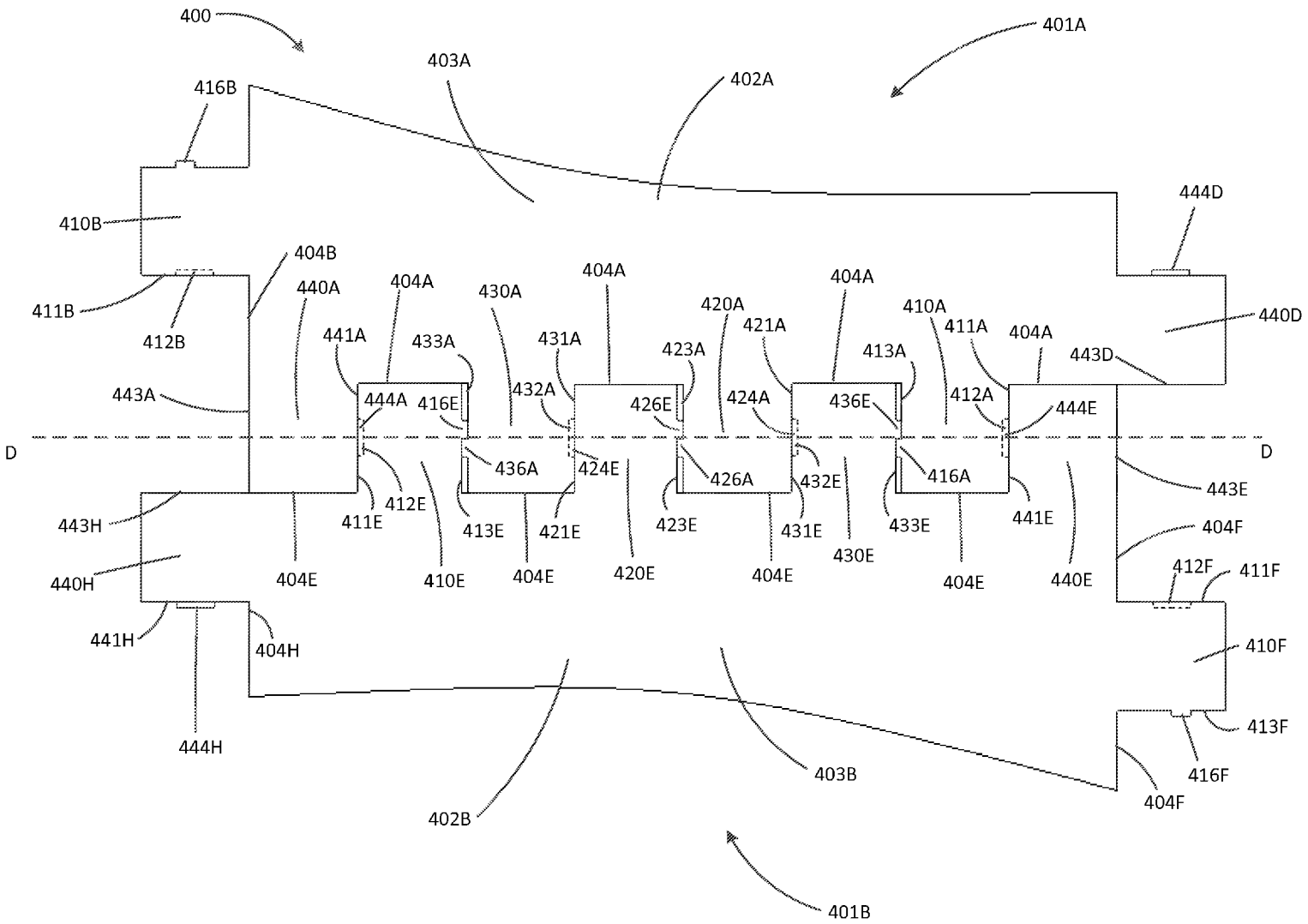
FIG. 7 is a schematic illustration of the system of FIG. 5 in a first engaged configuration.

FIG. 7 is a schematic illustration of the system 400 of FIG. 6 in a first engaged configuration. In this configuration, the first block 401A and the second block 401B are aligned such that a first face 403A of the first body 402A and a second face 403B of the second body 402B are in the same plane (i.e., the first face 403A and the second face 403B are coplanar). Additionally, the connectors extending from the sidewall 404A of the first block 401A are engaged with the connectors extending from the sidewall 404E of the second block 401B. In particular, the protrusion 444E is engaged with the recess 412A, the protrusion 424A is engaged with the recess 432E, the protrusion 424E is engaged with the recess 432A, and the protrusion 444A is engaged with the recess 412E.

Additionally, in the first engaged configuration, the flanges of the connectors extending from the sidewall 404E of the block 401B (i.e., 416E, 426E, 436E) lie in a bottom abutting relationship with the flanges of the connectors extending from the sidewall 404A of the block 401A (i.e., 436A, 426A, 416A). Said another way, the bottom side of the flanges 416E, 426E, and 436E engage with the bottom side of the flanges 436A, 426A, and 416A, respectively. This engagement between the flanges 416E, 426E, and 436E and the flanges 436A, 426A, and 416A, respectively, allows the first block 401A and the second block 401B to maintain the first engaged configuration (i.e., a coplanar and horizontally extending position) without external support or external application of force. Additionally, in the first engaged configuration, each pair of abutting flanges extend parallel to each other. In the first engaged configuration, a force required to separate the first block 401A from the second block 401B and applied in a direction perpendicular to a bottom surface of any of the flanges is greater than a force applied in a direction parallel to a bottom surface of any of the flanges required to separate the first block 401A from the second block 401B.

Additionally, an axis DD extends through the first recess 412A, the first protrusions 424A, the second recess 432A, and the second protrusion 444A. In some implementations, the axis BB extends through the center of the first protrusion 424A and the second protrusion 444A. Additionally, the axis DD lies in a plane (not shown) defined through the first connector 410A, the second connector 420A, the third connector 430A, the fourth connector 440A, the first connector 410E, the second connector 420E, the third connector 430E, and the fourth connector 440E. The plane lies perpendicular to the first body 402A and the second body 402B. Said another way, the plane lies parallel to the first sidewall 404A and the second sidewall 404E. Additionally, the plane and the axis DD within the plane are substantially halfway between the first sidewall 404A and the second sidewall 404E. In the first engaged configuration, with the abutting flanges extending parallel to each other, the flanges 416E, 426E, and 436E extend on a first side of the plane and the axis DD, and the flanges 436A, 426A, and 416A extend on a second side of the plane and the axis DD. Additionally, the sidewall 404A is on the same side of the plane and the axis DD as the flanges 416E, 426E, and 436E. The sidewall 404E is on the same side of the plane and the axis DD as the flanges 436A, 426A, and 416A.

Figure 8:
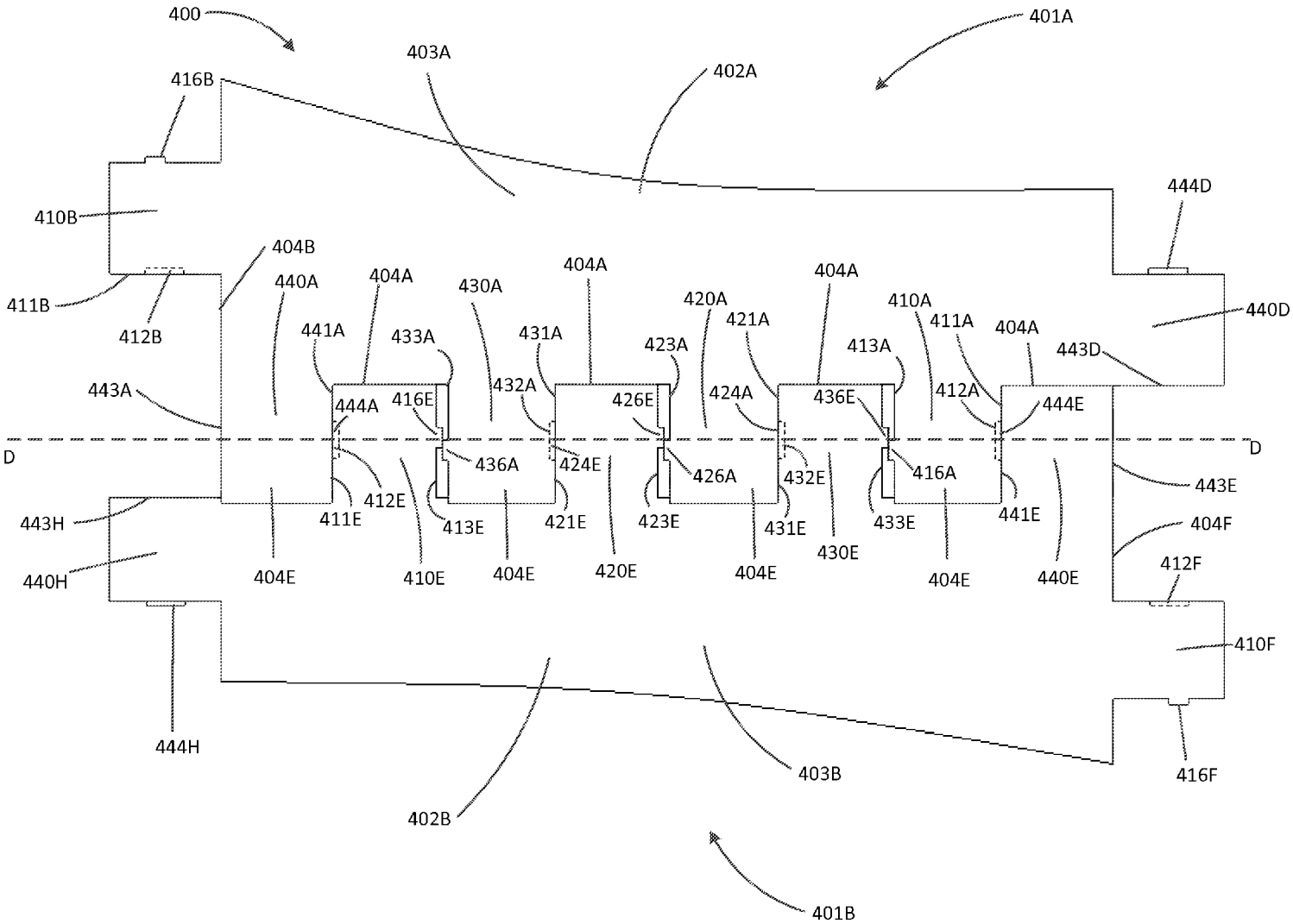
FIG. 8 is a schematic illustration of the system of FIG. 5 in a second engaged configuration.

FIG. 8 is a schematic illustration of the system 400 of FIG. 6 in a second engaged configuration. In this configuration, the second block 401B has been rotated relative to the first block 401A about the axis DD. As a result of the second block 401B being rotated and disposed at an angle relative to the first block 401A, the flanges of the connectors extending from the sidewall 404E of the block 401B (i.e., 416E, 426E, 436E) are also rotated from the bottom abutting configuration shown in FIG. 7 to a side abutting configuration. Said another way, when the first block 401A and the second block 401B are not coplanar but the protrusions 444E, 424A, 424E, and 444A are engaged with the recesses 412A, 432E, 432A, and 412E, respectively, the side surfaces of the flanges 436A, 426A, and 416A abut the side surfaces of the flanges 416E, 426E, and 436E, respectively.

In the second engaged configuration, an increased force is applied between the engaged protrusions and recesses as a result of the abutment of the side surfaces of the engaged flanges. For example, the abutment of the flange 416E and the flange 436A causes the connector 410E to be pushed into tighter contact with the connector 440A. In other words, the first side 411E of the connector 410E is pushed against the first side 441A of the connector 440A with greater force than when in the first engaged configuration, causing the protrusion 444A to have a more secure engagement with the recess 412E. Due to the more secure engagement between the protrusions 444E, 424A, 424E, and 444A and the recesses 412A, 432E, 432A, and 412E, the first block 401A and the second block 401B can maintain their relative positions without external support or external application of force.

However, a force required to separate the first block 401A from the second block 401B and applied in a direction perpendicular to a bottom surface of any of the flanges of either the first block 401A and/or the second block 401B in the first engaged configuration is greater than a force applied in a direction perpendicular to a bottom surface of any of the flanges of the first block 401A and/or the second block 401B required to separate the first block 401A from the second block 401B in the second engaged configuration.

Additionally, while the system 400 moves from the first engaged configuration to the second engaged configuration, each of the connectors 410E, 420E, 430E, and 440E maintain a substantially constant minimum distance from a portion of the sidewall of the first block 401A. For example, the connector 430E maintains a substantially constant minimum distance between an end surface of the connector 430E and the portion of the sidewall 504A extending between the connectors 510A and 520A while the second block 501B rotates relative to the first block 501A. In some embodiments, the connectors 410E, 420E, 430E, and 440E remain in abutting contact with no gap between an end surface of the connectors 410E, 420E, 430E, and 440E and the sidewall 404A. In other implementations, however, any suitable gap size may exist depending on the location of the engagement features (i.e. recesses and protrusions) and flanges relative to the distance the connectors extend from their respective sidewalls.

Figure 9:
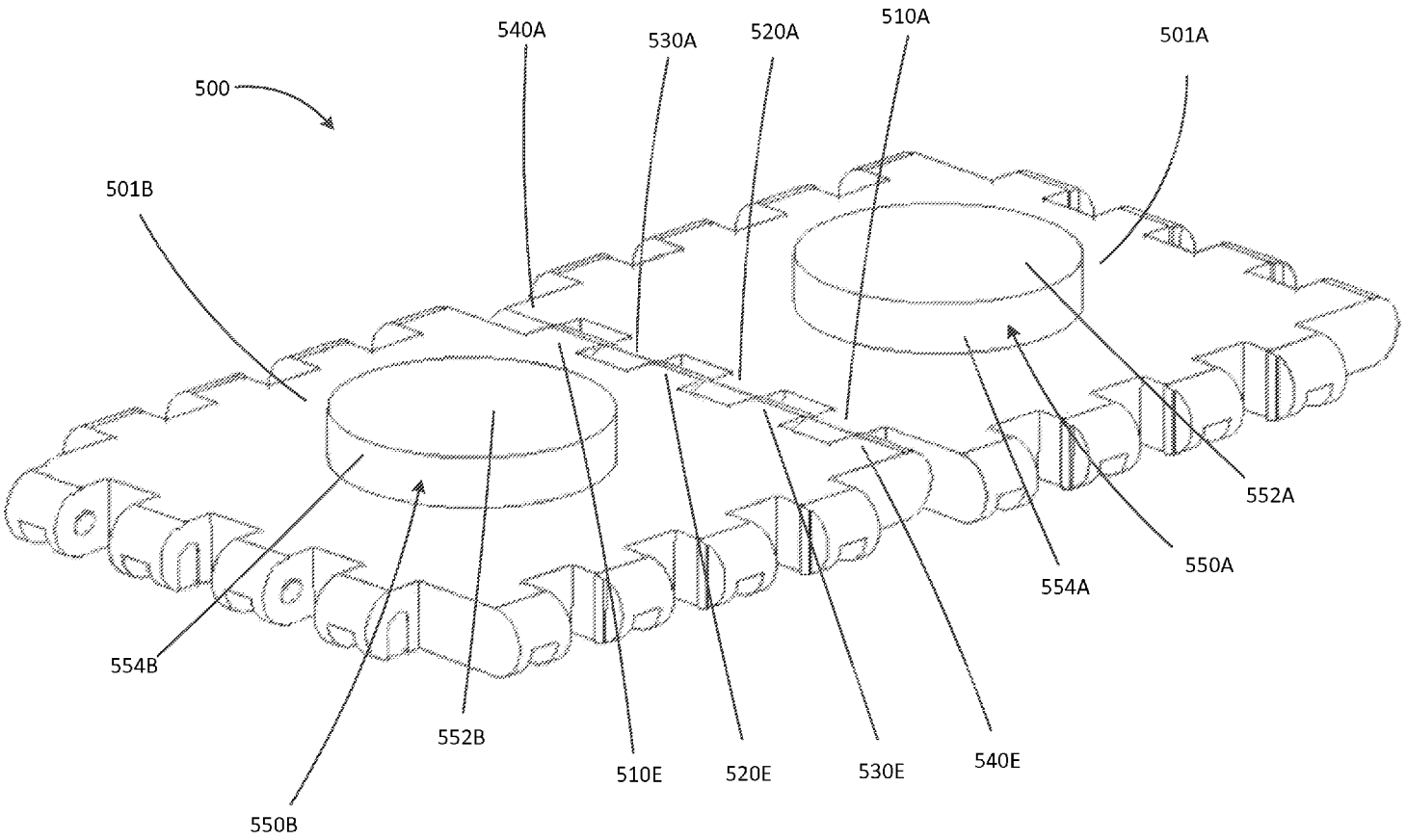
FIG. 9 is a perspective view of a system according to an embodiment in a first configuration.

FIG. 9 is a perspective view of a system 500 in a first configuration. The system 500 includes a first block 501A and a second block 501B. The first block 501A and the second block 501B are substantially identical to each other and to the block 200 described above with reference to FIGS. 2-4. The first configuration of the system 500 is similar to the first engaged configuration of the system 400 described above with reference to FIG. 7.

In particular, the first block 501A includes a first connector 510A, a second connector 520A, a third connector 530A, and a fourth connector 540A. The second block 501B includes a first connector 510E, a second connector 520E, a third connector 530E, and a fourth connector 540E. The first connector 510A and the first connector 510E are similar in structure and function to the first connectors 110A, 210A, 310A, 410A, and 410E, and will not be further described herein. The first connector 520A and the first connector 520E are similar in structure and function to the first connectors 120A, 220A, 320A, 420A, and 420E, and will not be further described herein. The first connector 530A and the first connector 530E are similar in structure and function to the first connectors 130A, 230A, 330A, 430A, and 430E, and will not be further described herein. The first connector 540A and the first connector 540E are similar in structure and function to the first connectors 140A, 240A, 340A, 440A, and 440E, and will not be further described herein.

Although not shown in the view of FIG. 9, each of the connectors 510A, 530A, 510E, and 530E includes a recess similar to recesses 212A and 232A shown and described with respect to the connectors 210A and 230A in FIGS. 2-4. Similarly to the recesses 212A and 232A, the recesses of the connectors 510A, 530A, 510E, and 530E extend to the bottom edge of each the connectors 510A, 530A, 510E, and 530E so that a reduced amount of force may be used to engage each recess with a protrusion when the first block 501A is coupled to the second block 501B via the connectors 510A, 520A, 530A, 540A, 510E, 520E, 530E, and 540E. Each of the connectors 520A, 540A, 520E, and 540E include a protrusion similar to the protrusions 224A and 244A shown and described with respect to the connectors 220A and 240A in FIGS. 2-4. The first block 501A can be coupled with the second block 501B via a user pushing the protrusions of the connectors 540E and 520E from the bottom edges of the connectors 510A and 530A into engagement with the recesses of the connectors 510A and 530A, respectively. As described above, however, the recesses of the connectors 510E and 530E also extend to the bottom edge of the connectors 510E and 530E. Therefore, the protrusions of connectors 540A and 520A will face greater resistance moving into engagement with the recesses of the connectors 510E and 530E as a result of not moving through the portion of the recess extending to the edge. Consequently, however, when the first block 501A and the second block 501B are coupled in the first position of FIG. 9, the recesses of the first block 501A and the second block 501B both extending toward the bottom edges of the connectors aids in maintaining the engagement between the engagement features (i.e., the protrusions and the recesses). For example, the protrusion of the connector 540A is deterred from disengaging from the recess of the connector 510E via the open edge of the recess because the top edge of the recess of connector 530A exerts an oppositely directed force against the protrusion of the connector 520E.

Additionally, although the connectors 510A, 520A, 530A, and 540A of the first block 501A are shown as engaging with the connectors 510E, 520E, 530E, and 540E of the second block 501B, any of the female connectors of the first block 501A can be engaged with any of the male connectors of the second block 501B.

The first block 501A also includes a raised portion 550A. The raised portion 550A includes an engaging sidewall 552A and an engaging face 554A. The block 501A also includes a mating portion (not shown). The raised portion 550A and the mating portion are similar in structure and function to the raised portion 250 and the mating portion 260 described above with reference to the block 200 and will not be further described herein. Similarly, the second block 501B includes a raised portion 550B. The raised portion 550B includes an engaging sidewall 552B and an engaging face 554B. The block 501B also includes a mating portion (not shown). The raised portion 550B and the mating portion are similar in structure and function to the raised portion 250 and the mating portion 260 described above with reference to the block 200 and will not be further described herein.

Figure 10:
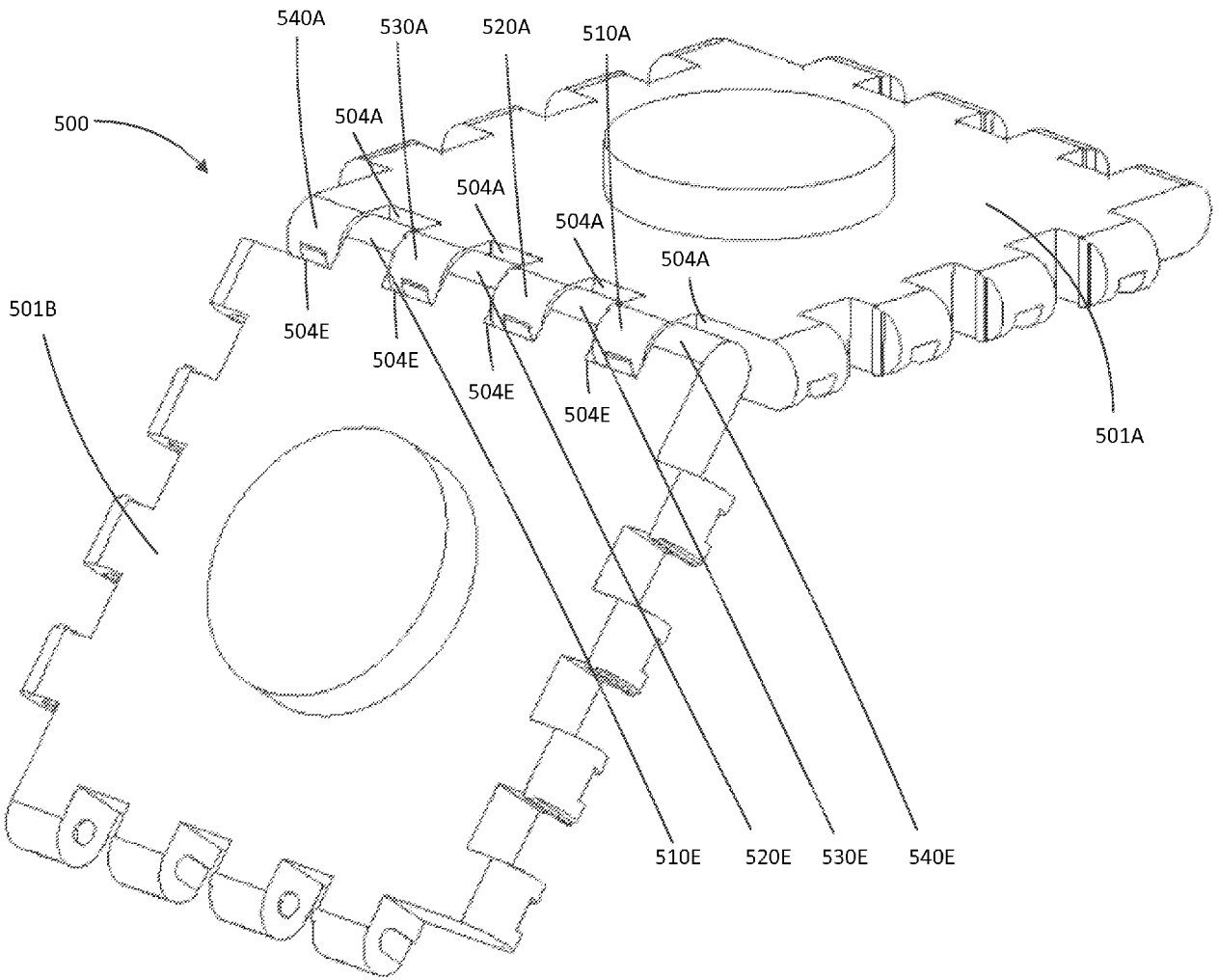
FIG. 10 is a perspective view of the system of FIG. 9 in a second configuration.

FIG. 10 is a perspective view of the system 500 in a second configuration. In the second configuration, the second block 501B has been rotated relative to the first block 501A about an axis extending through the connectors 540A, 510E, 530A, 520E, 520A, 530E, 510A, and 540E, similar to the second block 401B rotating relative to the first block 401A about an axis DD as described above with reference to FIG. 8. Similarly to the connectors 210A, 220A, 230A, and 240A described above with reference to FIGS. 2-4, the connectors 540A, 510E, 530A, 520E, 520A, 530E, 510A, and 540E each include a half-cylinder shaped end including a central axis. The central axis of each connector 540A, 510E, 530A, 520E, 520A, 530E, 510A, and 540E is colinear with the rotational axis around which the second block 401B rotates relative to the first block 401A when moving from the first configuration to the second configuration.

Additionally, the first block 501A has a first sidewall 504A. While the system moves from the first configuration to the second configuration, each of the connectors 510E, 520E, 530E, and 540E maintain a substantially constant minimum distance from a portion of the sidewall of the first block 501A. For example, the connector 530E maintains a substantially constant minimum distance between the half-cylinder shaped surface of the connector 530E and the portion of the sidewall 504A between the connectors 510A and 520A while the second block 501B rotates relative to the first block 501A.

Similarly, as indicated in FIG. 10, the second block 501B has a first sidewall 504E. While the system moves from the first configuration to the second configuration, each of the connectors 510A, 520A, 530A, and 540A maintain a substantially constant minimum distance from a portion of the sidewall of the second block 501B. For example, the connector 530A maintains a substantially constant minimum distance between the half-cylinder shaped surface of the connector 530A and the portion of the sidewall 504E between the connectors 510E and 520E while the second block 501B rotates relative to the first block 501A.

Each of the connectors 510E, 520E, 530E, and 540E maintains a substantially constant minimum distance between the half-cylinder shaped surface of each of the connectors 510E, 520E, 530E, and 540E and a portion of the sidewall 504A through at least the portion of the rotation of the second block 501B where the minimum distance from the sidewall 504A to each of the connectors 510E, 520E, 530E, and 540E is a distance between the half-cylinder shaped portion of each of the connectors 510E, 520E, 530E, and 540E and the sidewall 504A.

The second block 501B can be rotated relative to the first block 501A within a rotational range while maintaining constant engagement between the corresponding engagement features (i.e., the protrusions and the recesses) of the connectors of the first block 501A and the second block 501B. The rotational range is dependent on the specifics of the shapes of each block, such as, for example, the distance the connectors 510A, 520A, 530A, and 540A extend from the first block 501A, the distance the connectors 510E, 520E, 530E, and 540E extend from the second block 501B, the location of the engagement features (i.e., the protrusions and the recesses) relative to the sidewalls of the first block 501A and the second block 501B, and the shape of the sidewall edges of each of the first block 501A and the second block 501B. For example, if the first sidewall 504A is formed so that the edges are curved rather than perpendicular, the rotational range of the second block 501A relative to the first block 501B may be larger.

In some embodiments, each of the connectors 510E, 520E, 530E, and 540E can contact the bottom edge of the sidewall 504A at a first end of the range and each of the connectors 510E, 520E, 530E, and 540E can contact the top edge of the sidewall 504A at a second end of the range. When the second block 501B is rotated relative to the first block 501A beyond the rotational range, the engagement features of the second block 501B will disengage from the first block 501A as a result of the connectors 510E, 520E, 530E, and 540E exerting a force against the edge of the sidewall 504A and the edge of the sidewall 504E exerting a similar force against the connectors 510A, 520A, 530AE, and 540A.

The second configuration of the system 500 is similar to the second engaged configuration of the system 400 described above with reference to FIG. 8 and will not be further described herein.

Figure 11:
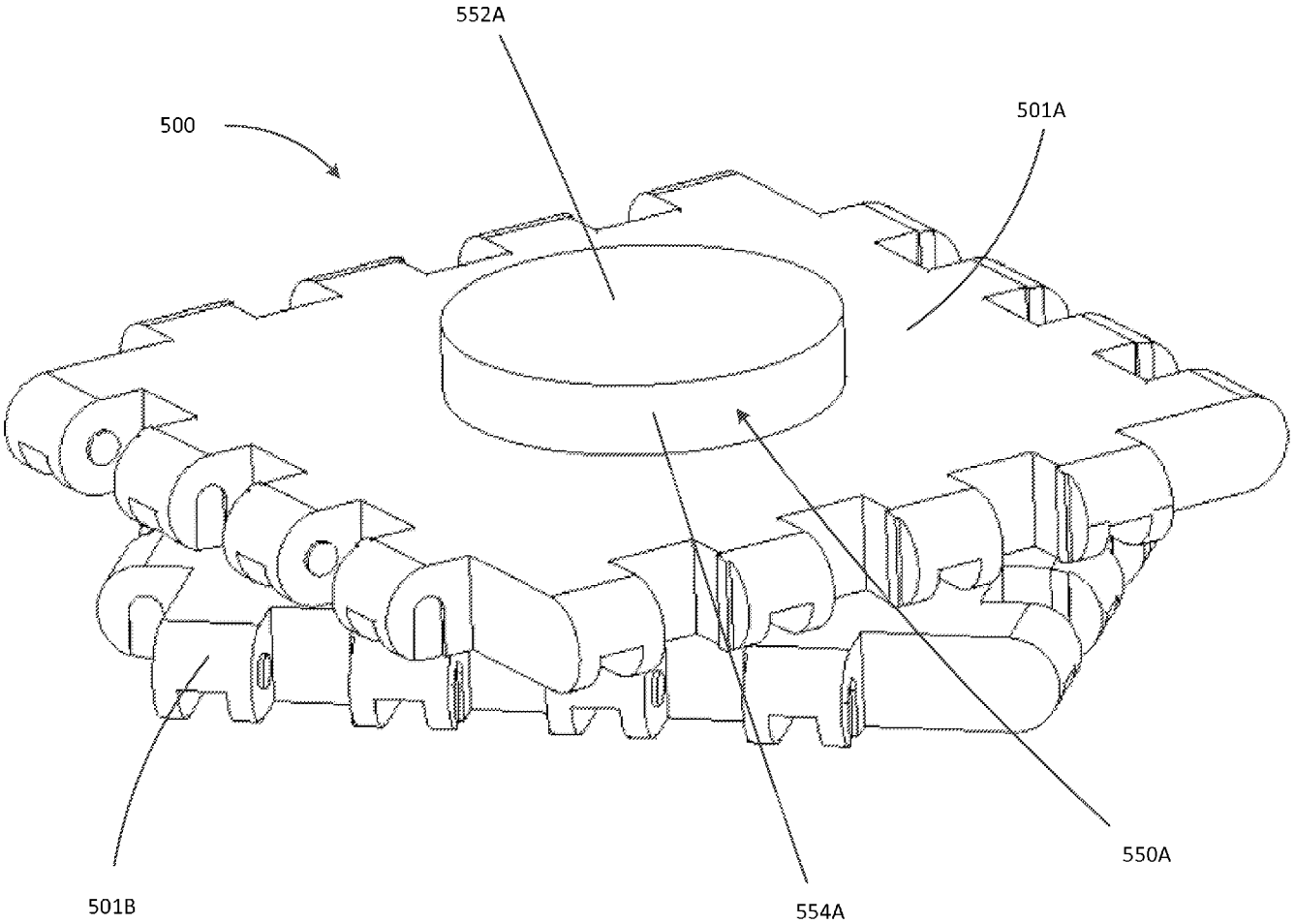
FIG. 11 is a perspective view of the system of FIG. 9 in a third configuration.

FIG. 11 is a perspective view of the system 500 in a third configuration. In the third configuration, the raised portion 550B of the second block 501B is engaged within the mating portion of the first block 501A. The engaging sidewall 552A is engaged with the protuberances (not shown) of the mating portion for a secure engagement.

Figure 12:
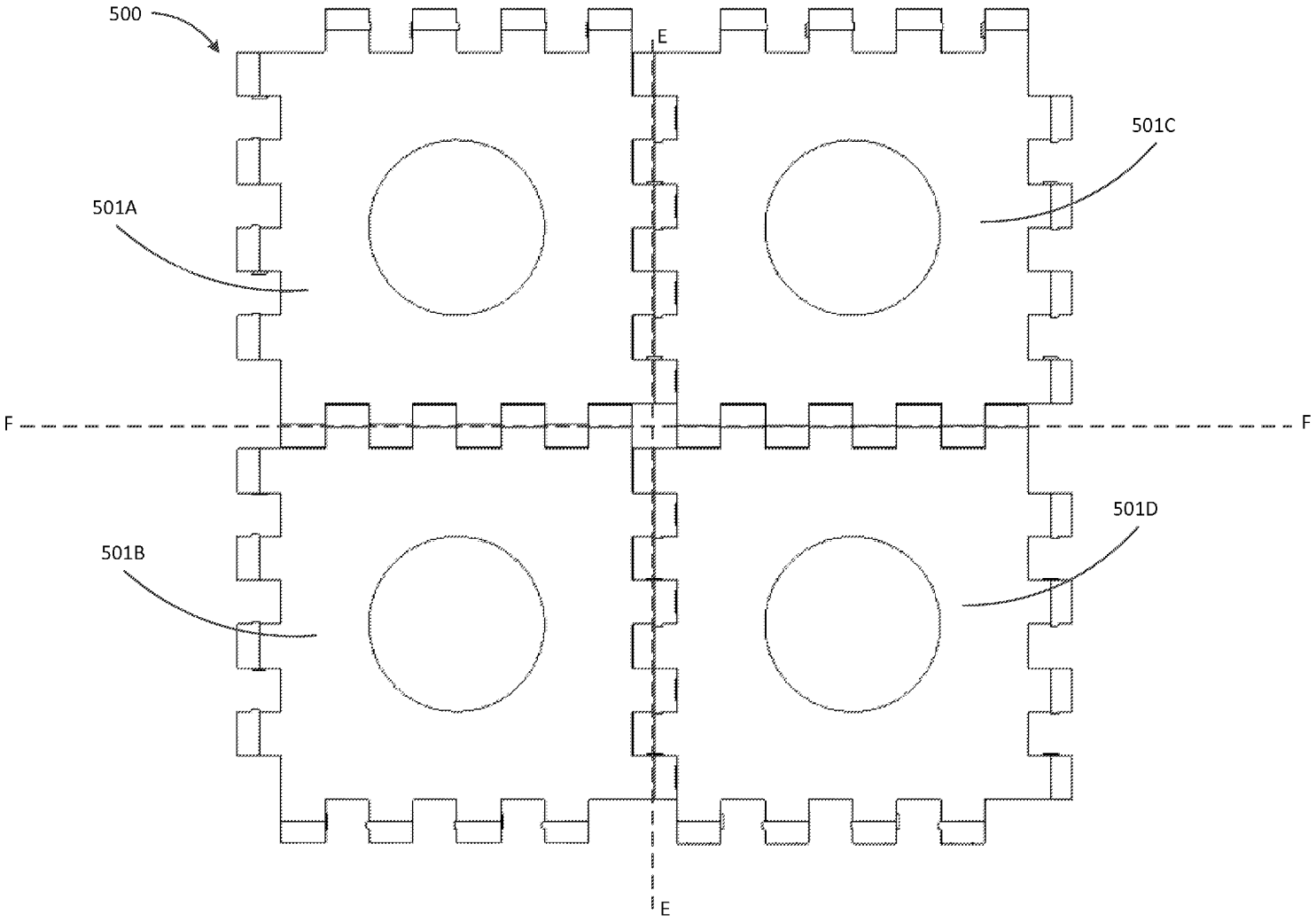
FIG. 12 is a top view of the system of FIG. 9 in a fourth configuration.

As a result of the first block 501A and the second block 501B being substantially identical in size and structure, any of the sides of the first block 501A can engage with and of the sides of the second block 501B. Additionally, the first block 501A and the second block 501B can be engaged with other blocks to form additional configurations. For example, FIG. 12 is a top view of the system 500 in a fourth configuration. The fourth configuration includes the first block 501A, the second block 501B, a third block 501C, and a fourth block 501D. The third block 501C and the fourth block 501D are similar in structure to the first block 501A and the second block 501B and will not be further described herein. The first block 501A is engaged with the second block 501B and the third block 501C. The fourth block 501D is engaged with the second block 501B and the third block 501C. Additionally, the blocks 501A, 501B, 501C, and 501D are coplanar. In this configuration, the first block 501A and the second block 501B can be rotated about an axis EE relative to the third block 501C and the fourth block 501D such that the first block 501A and the second block 501B remain coplanar and the third block 501C and the fourth block 501D are coplanar, but the first block 501A (and the second block 501B) is not coplanar with the third block 501C and the fourth block 501D. Similarly, from a position where the first block 501A, the second block 501B, the third block 501C, and the fourth block 501D are coplanar, the first block 501A and the third block 501C can be rotated relative about an axis FF relative to the second block 501B and the fourth block 501D such that the first block 501A and the third block 501C remain coplanar and the second block 501C and the fourth block 501D remain coplanar, but the first block 501A (and the third block 501C) is not coplanar with the second block 501B and the fourth block 501D.

Figure 13:
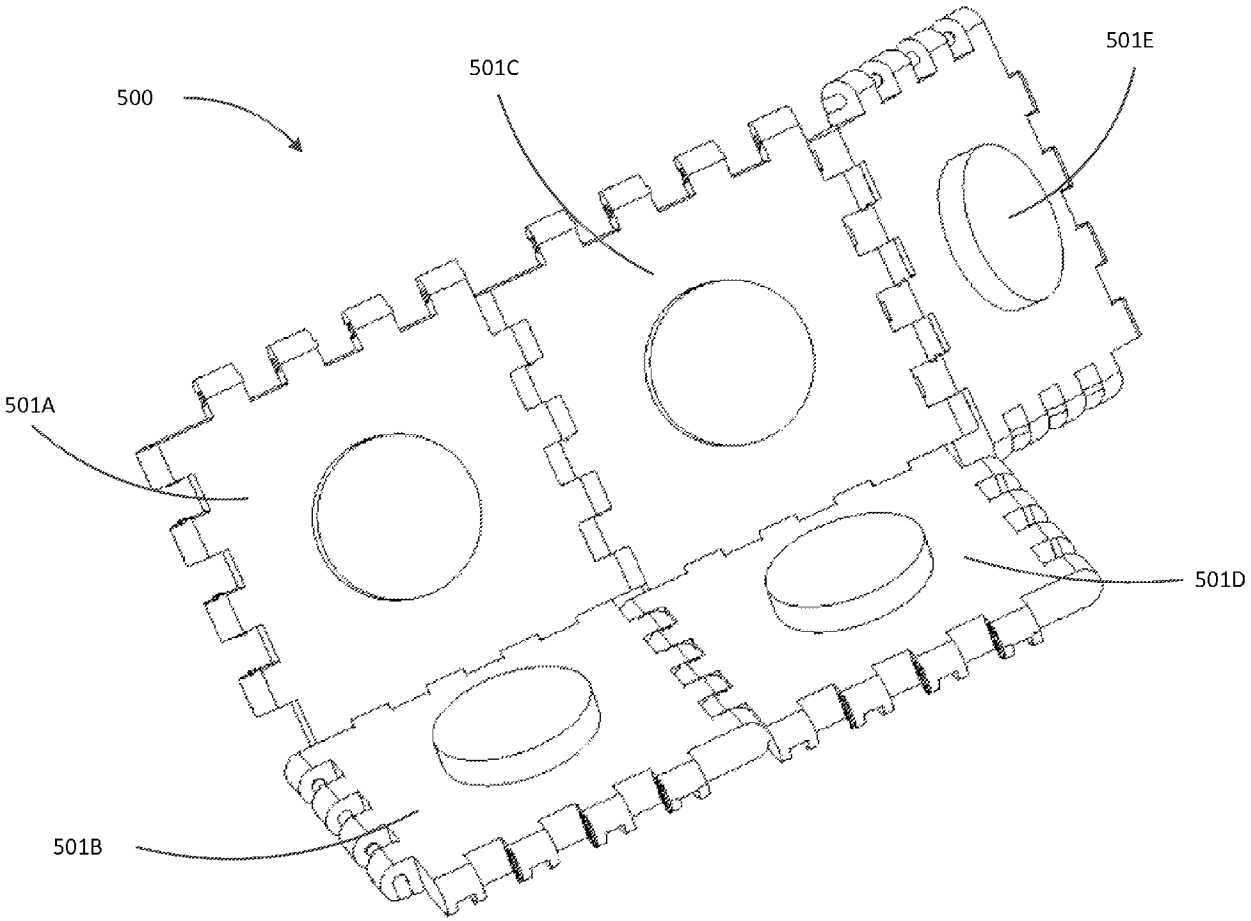
FIG. 13 is a perspective view of the system of FIG. 9 in a fifth configuration.

FIG. 13 is a perspective view of the system 500 in a fifth configuration. In the fifth configuration, the system 500 includes the first block 501A, the second block 501B, the third block 501C, the fourth block 501D, and a fifth block 501E. The fifth block 501E is similar in structure to the first block 501A, the second block 501B, the third block 501C, the fourth block 501D, and will not be further described herein. As shown in FIG. 13, the first block 501A and the third block 501C are coplanar. Additionally, the second block 501B and the fourth block 501D are coplanar. However, neither the first block 501A nor the third block 501C are coplanar with either the second block 501B nor the fourth block 501D. Also, the fifth block 501E is coupled to the third block 501C, but is not coplanar with the first block 501A, the second block 501B, the third block 501C, or the fourth block 501D.

Figure 14:
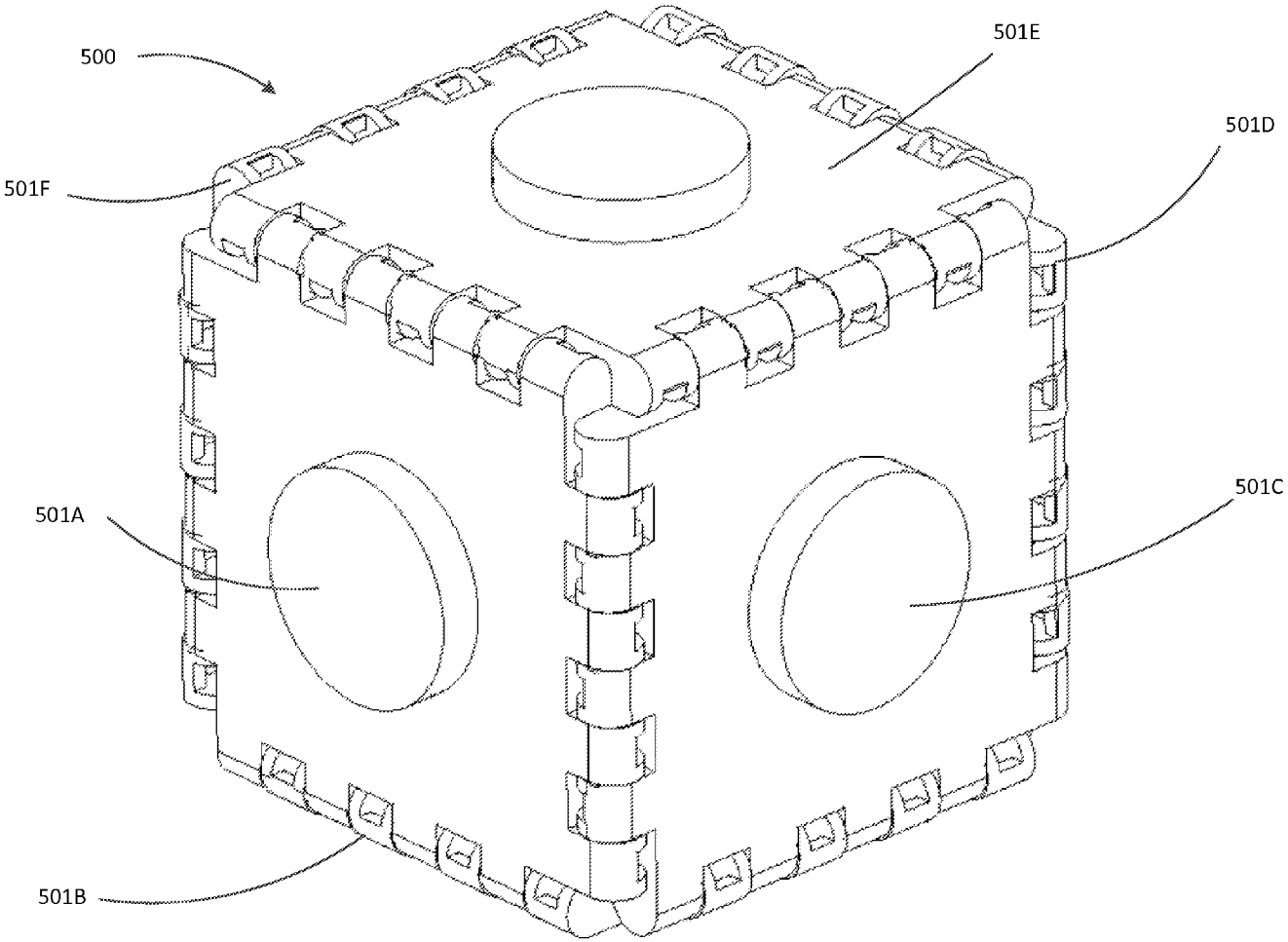
FIG. 14 is a perspective view of the system of FIG. 9 in a sixth configuration.

FIG. 14 is a perspective view of the system 500 in a sixth configuration. In the sixth configuration, the system 500 includes the first block 501A, the second block 501B, the third block 501C, the fourth block 501D, the fifth block 501E, and a sixth block 501F. The system 500 forms a cube shape in the sixth configuration, with each block being coupled to four other blocks (i.e., one block on each side). For example, the first block 501A is coupled to the second block 501B, the third block 501C, the fifth block 501E, and the sixth block 501F.

Figure 15:
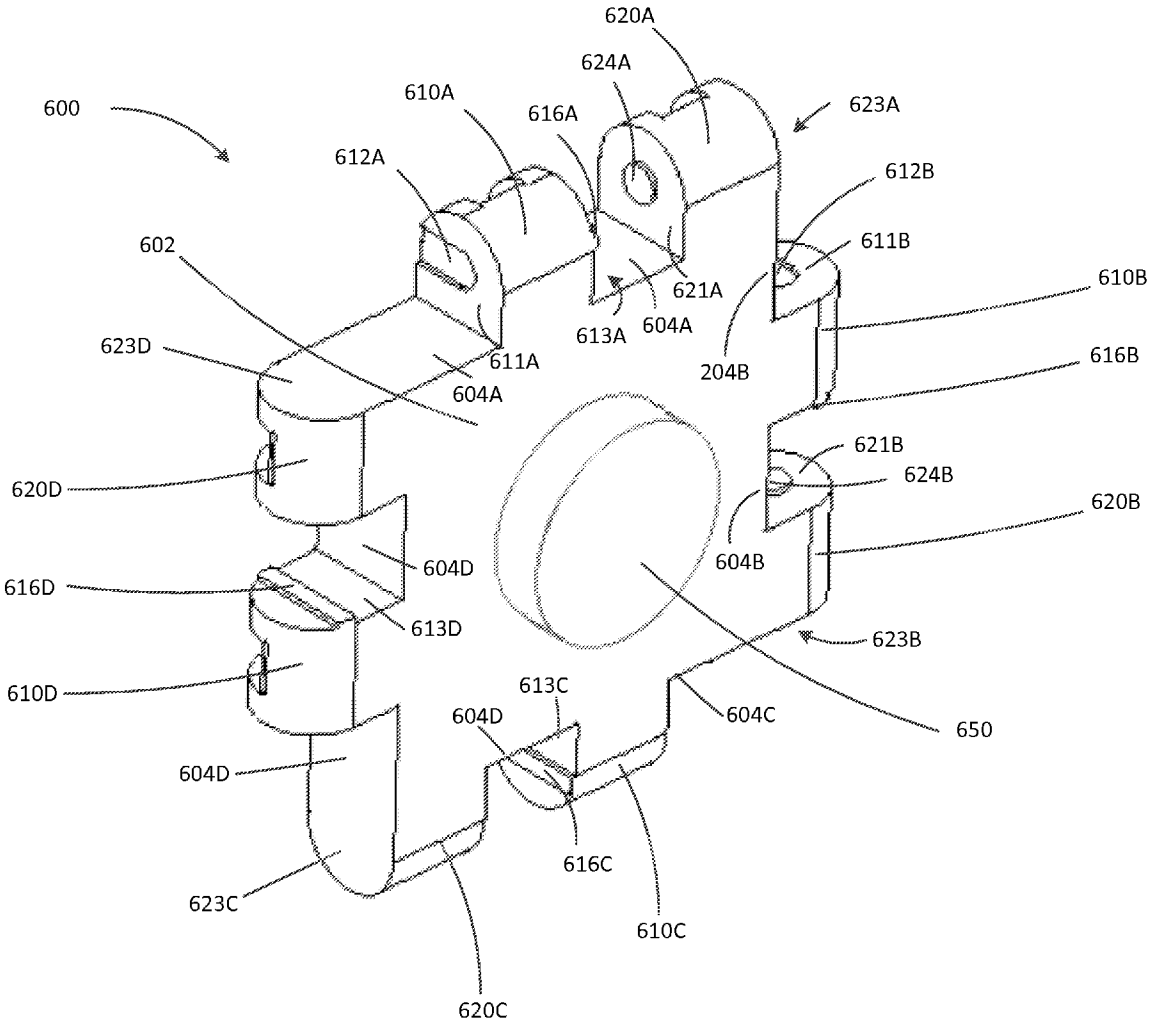
FIG. 15 is a perspective view of a block according to an embodiment.

Although the blocks have been described as having four connectors per side, the blocks can have any suitable number of connectors per side. For example, FIG. 15 is a perspective view of a block 600 according to an embodiment. Generally, the block 600 includes four sides with two connectors per side.

The block 600 includes a body 602 having a first sidewall 604A, a second sidewall 604B, a third sidewall 604C, and a fourth sidewall 604D. The block 600 includes a first connector 610A and a second connector 620A extending from the first sidewall 604A. Extending from the second sidewall 604B, the block 600 includes a third connector 610B and a fourth connector 620B. Extending from the third sidewall 604C, the block 600 includes a fifth connector 610C and a sixth connector 620C. Extending form the fourth sidewall 604D, the block 600 includes a seventh connector 610D and an eighth connector 620D.

Similarly to the block 100 described above with respect to FIGS. 1A and 1B, each of the connectors of the block 600 includes a first side and a second side. For example, with respect to the connectors extending from the first sidewall 604A, the first connector 610A includes a first side 611A and a second side indicated at 613A. The second connector 620A includes a first side 621A and a second side indicated at 623A. The second side 613A of the first connector 610A faces the first side 621A of the second connector 620A.

Similarly to the connectors extending from the first sidewall 604A, the connectors extending from the second sidewall 604B also include a first side and a second side. Specifically, the third connector 610B includes a first side 611B and a second side (not shown). The fourth connector 620B includes a first side 621B and a second side indicated at 623B.

Also similarly to the connectors extending from the first sidewall 604A, the connectors extending from the third sidewall 604C also include a first side and a second side. Specifically, the fifth connector 610C includes a first side (not shown) and a second side 613C. The sixth connector 620C includes a first side (not shown) and a second side 623C.

Additionally, similarly to the connectors extending from the other sidewalls (604A, 604B, 604C), the connectors extending from the fourth sidewall 604D include a first side and a second side. Specifically, the seventh connector 610D includes a first side (not shown) and a second side 613D. The eighth connector 620D includes a first side (not shown) and a second side 623D.

Similarly to block 100 described with respect to FIG. 1, the connectors of the block 600 are arranged such that female and male connectors alternate along the sidewalls of the block 600. The first connector on each side (i.e., connectors 610A, 610B, 610C, and 610D) are female connectors. For example, the female connectors 610A and 610B include recesses 612 and 612B, respectively. Although not shown in FIG. 15, the female connectors 610C and 610D also include recesses. The recesses are located on the first side of each of the female connectors. For example, as shown in FIG. 15, the recess 612A is located on the first side 611A of the connector 610A, and the recess 612B is located on the first side 611B of the connector 610B. Although not shown, the recesses of female connectors 610C and 610D are also located on the first side of each of the connectors 610C and 610D.

In contrast, the second connector on each side (i.e., connectors 620A, 620B, 620C, and 620D) are male connectors. For example, the male connectors 620A and 620B include protrusions 624A and 624B, respectively. Although not shown in FIG. 15, the male connectors 620C and 620D also include protrusions. The protrusions are located on the first side of each of the male connectors. For example, as shown in FIG. 15, the protrusion 624A is located on the first side 621A of the connector 620A and the protrusion 624B is located on the first side 621B of the connector 620B. Although not shown, the protrusions of the male connectors 620C and 620D are also located on the first side of each of the connectors 620C and 620D.

As shown in FIG. 15, the connectors 610A, 610B, 610C, and 610D each include a flange 616A, 616B, 616C, and 616D, respectively. The flanges project outwardly from the second side of each of the connectors 610A, 610B, 610C, and 610D. For example, the flange 616A projects outwardly from the second side 613A of the first connector 610A. The flange 616B projects outwardly from the second side of the third connector 610B. The flange 616C projects outwardly from the second side 613C of the fifth connector 610C. The flange 616D projects outwardly from the second side 613D of the seventh connector 610D. Each flange of the block 200 is similar in structure and function to the first flange 116A, the second flange 126A, and the third flange 136A described above with reference to block 100 and will not be further described herein.

The second sides (i.e., 623A, 623B, 623C, and 623D) of the connectors 620A, 620B, 620C, and 620D are each a smooth, continuous surface. Said another way, the second sides (i.e., 623A, 623B, 623C, and 623D) of the connectors 620A, 620B, 620C, and 620D do not include an engagement feature or a flange. Additionally, the second sides (i.e., 623A, 623B, 623C, and 623D) of the connectors 620A, 620B, 620C, and 620D each have a smooth and continuous intersection with their respective adjacent sidewalls. Said another way, the second sides (i.e., 623A, 623B, 623C, and 623D) of the connectors 620A, 620B, 620C, and 620D each lie in the same plane as their respective adjacent sidewalls. For example, the second side 623A of the second connector 620A and the second sidewall 604B of the body 602 lie in the same plane and have a smooth and continuous intersection. The second side 623B of the fourth connector 620B and the third sidewall 604C of the body 602 lie in the same plane and have a smooth and continuous intersection. The second side 623C of the sixth connector 620C and the fourth sidewall 604D of the body 602 lie in the same plane and have a smooth and continuous intersection. The second side 623D of the eighth connector 620D and the first sidewall 604A of the body 602 lie in the same plane and have a smooth and continuous intersection.

The second side 613A of the first connector 610A extends along a centerline (not shown) of the body 602 (similar to centerline AA of the body 102 described above with reference to FIG. 1). The first side 621A of the second connector 620A is arranged along the first sidewall 604A such that the first side 621A is offset from the centerline. The first connector 610A and the second connector 620A have widths taken along a line parallel to the first sidewall 604A that are substantially equal. Additionally, the first connector 610A and the second connector 620A are separated by a distance substantially equal to the width of at least one of the first connector 610A and the second connector 620A. In other words, the distance of the space between the first connector 610A and the second connector 620A is wide enough such that a connector of the same width as any of the first connector 610A and/or the second connector 620A can be positioned between the first connector 610A and the second connector 620A.

The two connectors extending from and in combination with each sidewall (i.e., 604A, 604B, 604C, 604D) are substantially similar in structure and function as the third connector 130A, and the fourth connector 140A in combination with sidewall 104A described above with reference to FIGS. 1A and 1B and the third connector 230A, and the fourth connector 240A in combination with sidewall 204A described above with reference to FIGS. 2-4. Said another way, the two connectors extending from each sidewall of the block 600 are substantially identical in structure and spacing to each of the other sets of two connectors extending from each of the other sidewalls of the block 600. Therefore, the connectors of the block 600 will not be further described herein. Additionally, the block 600 includes a raised portion 650 and a mating portion (not shown). The raised portion 650 and the mating portion are similar in structure and function to the raised portion 250 and the mating portion 260 described above with reference to the block of FIGS. 2-4 and will not be further described herein.

Figure 16:
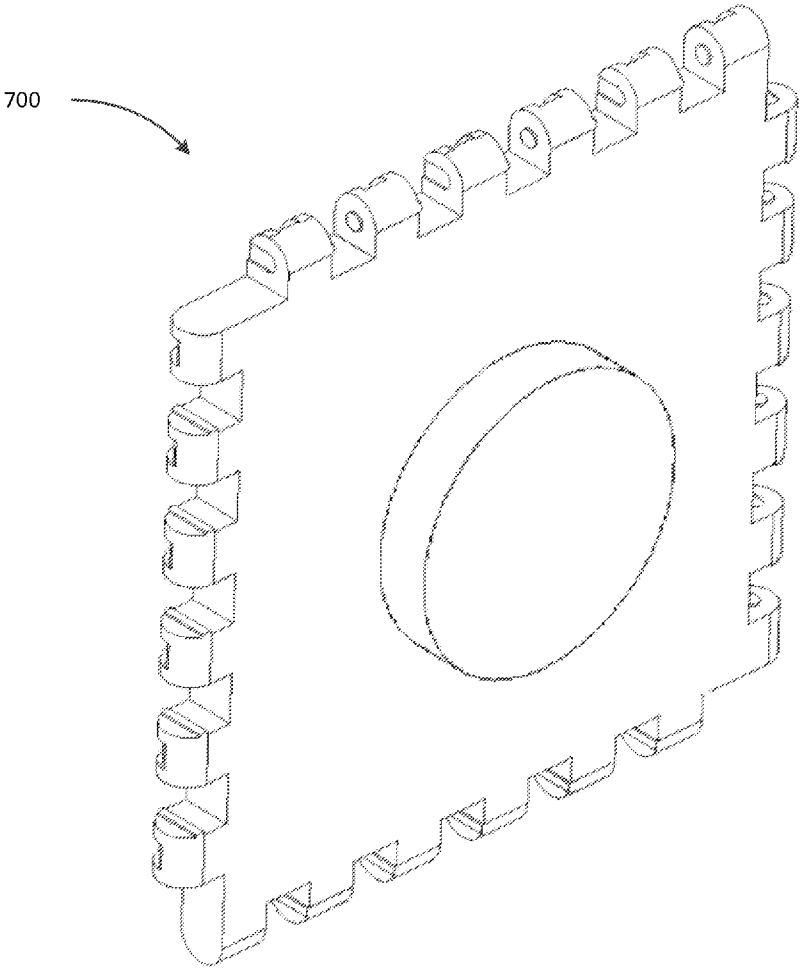
FIG. 16 is a perspective view of a block according to an embodiment.

In other implementations, the block can have more than four connectors per side. For example, FIG. 16 is a perspective view of a block 700 according to an embodiment. The block 700 includes four sides with six connectors per side. With the exception of having one addition male connector and one additional female connector per side, the block 700 is similar in structure and function to the block 200 described above with reference to FIGS. 2-4, and will not be further described herein.

Figure 17:
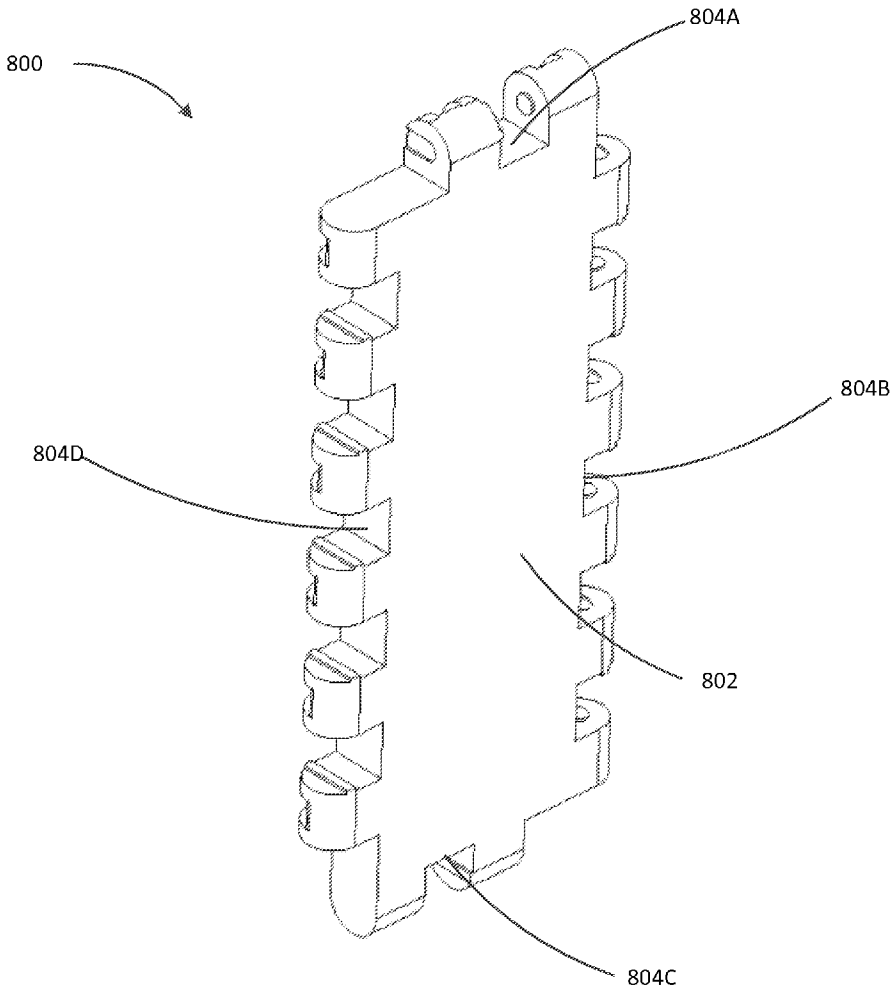
FIG. 17 is a perspective view of a block according to an embodiment.

Although the blocks have been described as having the same number of connectors per side, in some implementations the blocks can have different numbers of connectors per side. For example, FIG. 17 is a perspective view of a block 800 according to an embodiment. The block 800 includes a body 802, a first sidewall 804A, a second sidewall 804B, a third sidewall 804C, and a fourth sidewall 804D. Two connectors extend from each of the first sidewall 804A and the third sidewall 804C. Six connectors extend from each of the second side 804B and fourth side 804D. With the exception of having two sides with two connectors and two sides with six connectors, the block 800 is similar in structure and function to the block 200 described above with reference to FIGS. 2-4, and will not be further described herein.

Figure 18:
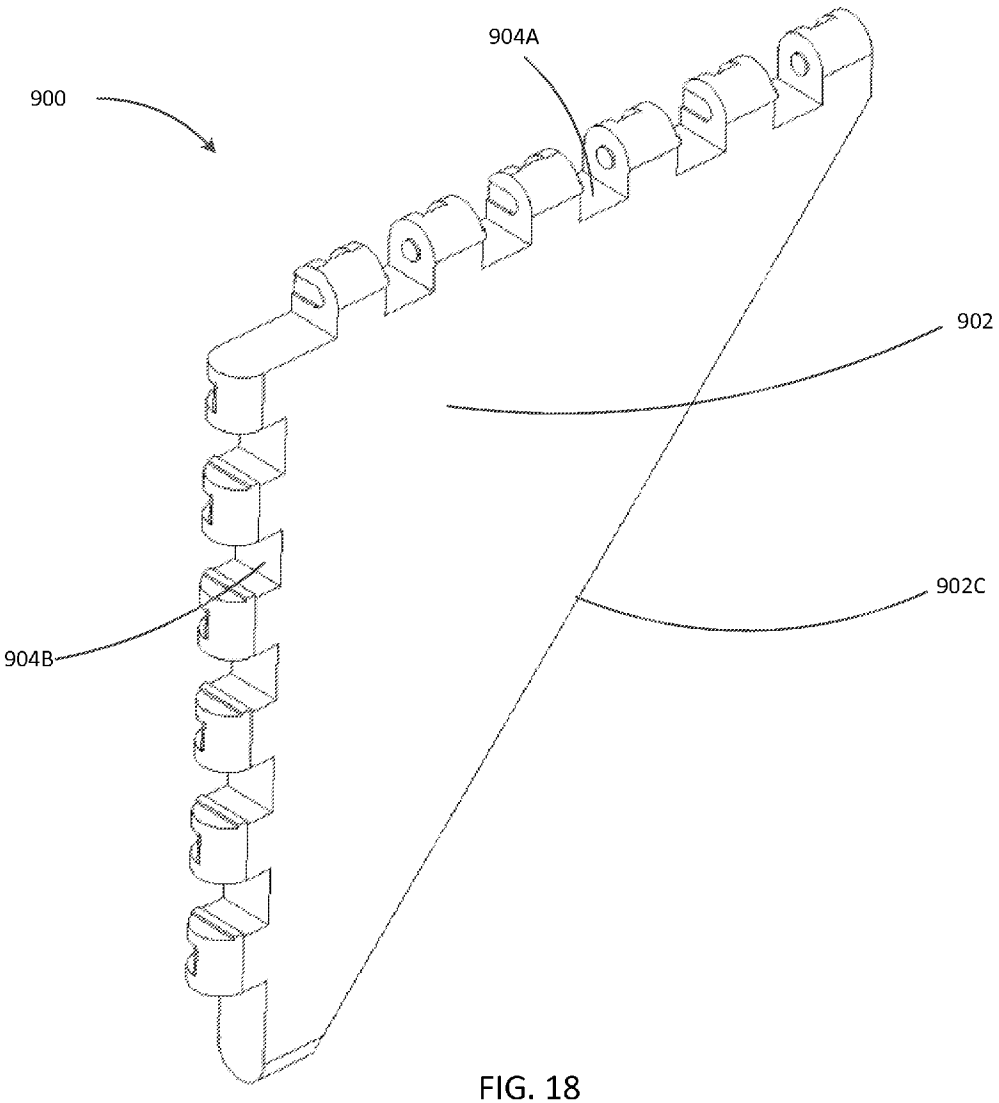
FIG. 18 is a perspective view of a block according to an embodiment.

Although the blocks have been described as having a rectangular or square body shape (e.g., body 102), in some implementations the blocks can have other shapes, such as, for example, a triangular shape. For example, FIG. 18 is a perspective view of a block 900 with a triangular body 902 according to an embodiment. Additionally, the triangular body has a first sidewall 904A, a second sidewall 904B, and a third sidewall 904C. Six connectors extend from the first sidewall 904A and six connectors extend from the second sidewall 904B. The third sidewall 904C is smooth and continuous. In other words, no connectors extend from the sidewall 904C. With the exception of having three sidewalls with six connectors extending from two of the sidewalls and the third sidewall being smooth and continuous, the block 900 is similar in structure and function to the block 200 described above with reference to FIGS. 2-4, and will not be further described herein.

Figure 19:
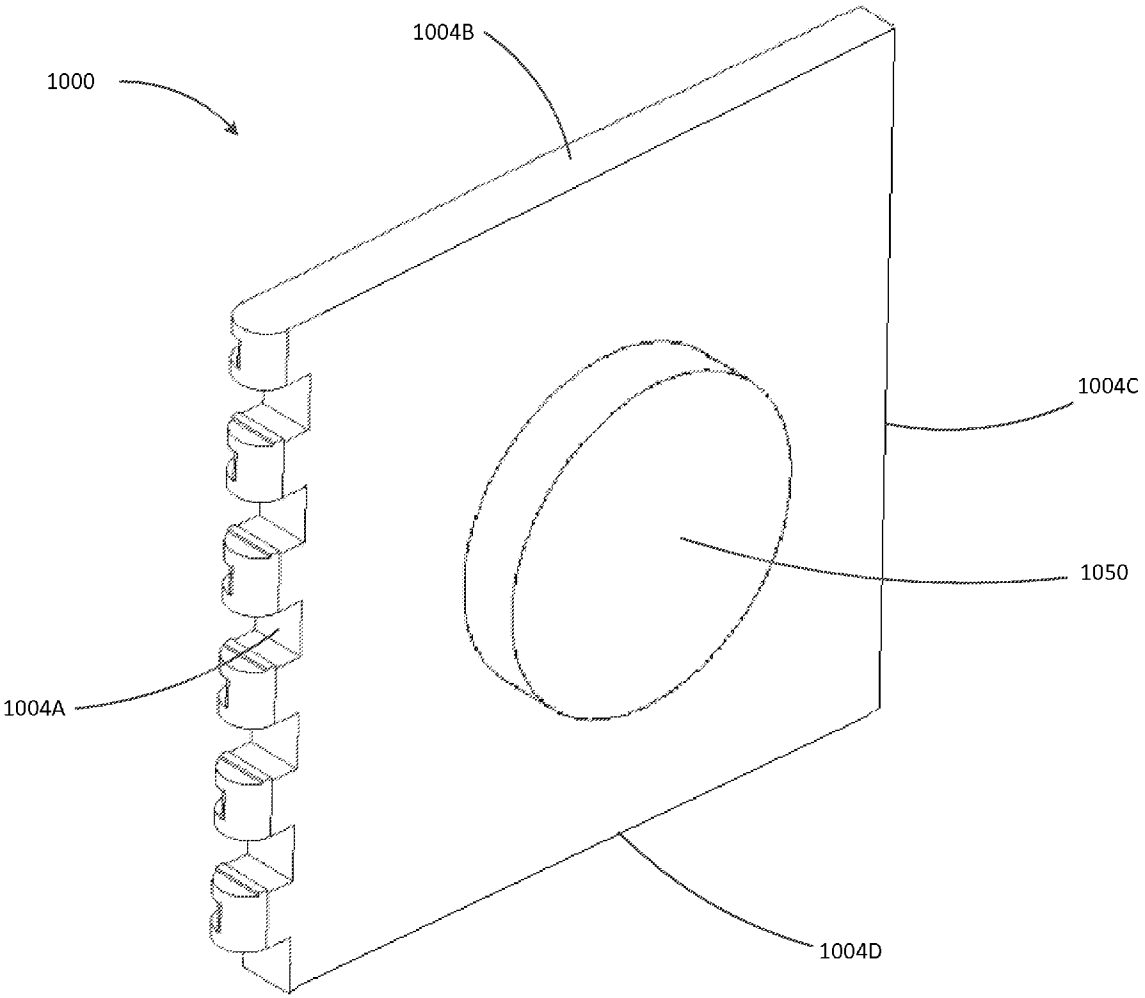
FIG. 19 is a perspective view of a block according to an embodiment.

FIG. 19 is a perspective view of a block 1000 according to an embodiment. The block 1000 includes a first sidewall 1004A, a second sidewall 1004B, a third sidewall 1004C, and fourth sidewall 1004D. Six connectors extend from the first sidewall 1004A. The second sidewall 1004B, the third sidewall 1004C, and the fourth sidewall 1004D are smooth and continuous. In other words, no connectors extend from the second sidewall 1004B, the third sidewall 1004C, and the fourth sidewall 1004D. With the exception of having six connectors rather than four, the connectors extending from the first sidewall 1004A are similar in structure and function to the connectors 210A, 220A, 230A, and 240A of the block 200 described above with reference to FIGS. 2-4, and will not be further described herein.

Additionally, the block 1000 includes a raised portion 1050. The raised portion 1050 is similar in structure and function to the raised portion 250 described above with respect to block 200 shown in FIGS. 2-4 and will not be described further herein.

Figure 20:
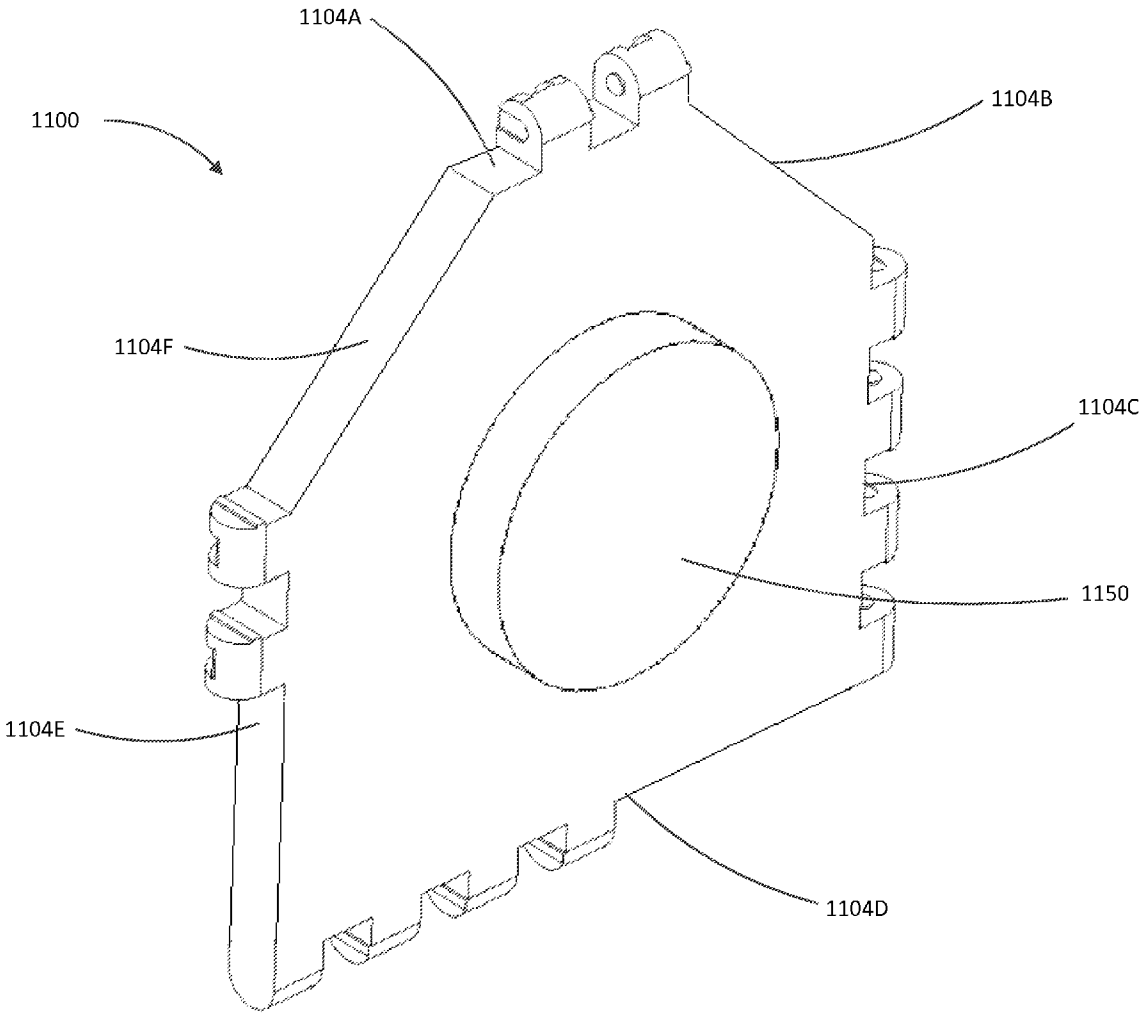
FIG. 20 is a perspective view of a block according to an embodiment.

FIG. 20 is a perspective view of a block 1100 according to an embodiment. The block 1100 includes a first sidewall 1104A, a second sidewall 1104B, a third sidewall 1104C, a fourth sidewall 1104D, a fifth sidewall 1104E, and a sixth sidewall 1104F. Two connectors extend from the first sidewall 1104A. The second sidewall 1104B and the sixth sidewall 1104F are smooth and continuous. In other words, no connectors extend from the second sidewall 1104B and the sixth sidewall 1104F. Four connectors extend from the third sidewall 1104C. A first portion of the fourth sidewall 1104D is smooth and continuous. Four connectors extend from a second portion of the fourth sidewall 1104D. The first portion is about half of the fourth sidewall 1104D and the second portion is about half of the fourth sidewall. The fifth sidewall 1104E includes a first portion that is smooth and continuous. Two connectors extend from a second portion of the fifth sidewall 1104E.

Additionally, the third sidewall 1104C is perpendicular to the fourth sidewall 1104D. The fourth sidewall 1104D is perpendicular to the fifth sidewall 1105E. In contrast, the second sidewall 1104B is arranged at an obtuse angle to the first sidewall 1104A and the third sidewall 1104C. Similarly, the sixth sidewall 1104F is arranged at an obtuse angle to the fifth sidewall 1104E and the first sidewall 1104A.

The blocks described herein can be made of any suitable material. For example. the blocks can be formed of a plastic, such as acrylonitrile butadiene styrene (ABS). Additionally, the blocks can be made in any suitable size. In some implementations, the blocks described herein can be monolithically constructed. In other implementations, the blocks can be constructed from two or more separately constructed components that are later joined together.

Although the blocks are described above as including flanges on a number of the connectors, in some implementations none of the connectors of a block have flanges. In such an implementation, for example, the width of a first connector of a first block can be sized such that a width of the first connector can be coupled in a space between a second and third connector of a second block such that an interference fit and/or engagement features (i.e., a recess or a protrusion) between the first connector and the second and/or third connectors couples the first block to the second block.

Although the blocks are described above as having a raised portion on a front face and a mating portion on a back face, in some implementations the blocks may include only one of a raised portion or a mating portion. In other implementations, the blocks may not have either of a raised portion or a mating portion. Additionally, although the blocks are described at times as having smooth, continuous surfaces on a number of connector sides, in some implementations the sides indicated as smooth and continuous may include an engagement feature or a flange if the block is intended to engage with another block in a particular orientation.

While various embodiments have been described above, it should be understood that they have been presented in a way of example only, and not limitation. Where schematics and/or embodiments described above indicate certain components arranged in certain orientations or positions, the arrangement of components may be modified. For example, although particular configurations of blocks have been described, the blocks described herein can be engaged with any suitable number of other blocks in any suitable configuration. While the embodiments have been particularly shown and described, it will be understood that various changes in form and details may be made.

Although various embodiments have been described as having particular features and/or combinations of components, other embodiments are possible having a combination of any features and/or components form any of the embodiments as discussed above.

The invention claimed is:

1. An apparatus, comprising:

a body;

a first connector extending from the body, the first connector having a first side and a second side and including a first engagement feature on the first side of the first connector and a first flange on the second side of the first connector, the first flange projecting outwardly from the second side of the first connector; and a second connector extending from the body spaced apart from the first connector, the second connector having a first side and a second side and including a second engagement feature on the first side of the second connector and a second flange on the second side of the second connector, the second flange projecting outwardly from the second side of the second connector, the first side of the first connector facing the second side of the second connector.

2. The apparatus of claim 1, wherein the first connector and the second connector extend a first distance from the body, the body being on a first side of a plane defined through the first connector and the second connector, the plane being perpendicular to the body, at a second distance from the body, the first flange and the second flange positioned on a second side of the plane.

3. The apparatus of claim 1, wherein the first engagement feature is one of a protrusion or a recess and the second engagement feature is one of a recess or a protrusion.

4. The apparatus of claim 1, wherein the body includes a centerline, the first side of the first connector extending along the centerline, and the second side of the second connector being arranged offset from the centerline.

5. The apparatus of claim 1, wherein the first connector has a first width, the second connector has a second width equal to the first width, and the first connector and the second connector are spaced apart by a distance substantially equal to the first width.

6. The apparatus of claim 1, wherein the body includes a face and a sidewall, the first connector and the second connector extending from the sidewall, the body further including a raised portion extending from the face, the raised portion having a width.

7. The apparatus of claim 6, wherein the face is a first face and the body further includes a second face, the second face including a mating portion, the mating portion defining a cavity.

8. The apparatus of claim 7, wherein the mating portion includes a protuberance that extends into the cavity.

9. The apparatus of claim 3, wherein the recess extends to an edge of the first connector or the second connector.

10. The apparatus of claim 1, wherein an axis extends through the first engagement feature and the second engagement feature.

11. The apparatus of claim 1, wherein the first connector has a first width, the second connector has a second width different from the first width, and the first connector and the second connector are spaced apart by a distance equal to the first width.

12. A system, comprising:

a first block including a first body and a first connector extending from the first body, the first connector having a first side and a second side and including a first engagement feature on the first side of the first connector and a flange on the second side of the first connector, the flange of the first connector having a bottom surface facing the first body and a side surface in a plane perpendicular to the first body;

a second block including a second body, a second connector, and a third connector, the second connector and the third connector extending from the second body, the second connector having a first side and a second side and including a flange on the second side of the second connector, the flange of the second connector having a bottom surface facing the second body and a side surface in a plane perpendicular to the second body, the third connector spaced apart from the second connector, the third connector having a first side and a second side and including a second engagement feature on the first side, the second side of the second connector facing the first side of the third connector, in a first configuration, the first block and the second block being aligned such that the bottom surface of the flange of the first connector and the bottom surface of the flange of the second connector are abutting, in a second configuration, the first block and the second block being aligned such that the side surface of the flange of the first connector and the side surface of the flange of the second connector are abutting.

13. The system of claim 12, wherein the first engagement feature is one of a protrusion or a recess and the second engagement feature is one of a recess or a protrusion.

14. The system of claim 13, wherein when in the first configuration and in the second configuration, the recess is engaged with the protrusion, and the second block is configured to rotate relative to the first block from the first configuration to the second configuration around an axis defined through the protrusion.

15. The system of 14, wherein a sidewall of the second block is disposed between the second connector and the third connector, and, while the system moves from the first configuration to the second configuration, the first connector maintains a substantially constant distance from a portion of the sidewall of the second block.

16. The system of claim 12, wherein in the first configuration, the first engagement feature is engaged with the second engagement feature and a first force acts between the first engagement feature and the second engagement feature, and in the second configuration, the first engagement feature is engaged with the second engagement feature and a second force greater than the first force acts between the first engagement feature and the second engagement feature.

17. The system of claim 12, wherein the first body includes a first face and a sidewall, the first connector extending from the sidewall, the first body further including a raised portion extending from the face, the raised portion having a width; and the second body includes a mating portion, the mating portion defining a cavity, the mating portion including a protuberance that extends into the cavity; in a configuration, the raised portion is engaged with the protuberance of the mating portion.

18. The system of claim 12, wherein the first block and the second block are substantially identical in structure and size.

19. The system of claim 13, wherein the recess extends to an edge of the first connector or the third connector.

20. The system of claim 12, wherein the second connector includes a half-cylinder shaped end including a central axis, the central axis being a rotational axis around which the first block rotates relative to the second block while the system moves from the first configuration to the second configuration.

21. The system of claim 12, wherein a force required to separate the first block from the second block and applied in a direction perpendicular to the bottom surface of the flange in the first configuration is greater than a force applied in a direction perpendicular to the bottom surface of the flange required to separate the first block from the second block in the second configuration.

22. The system of claim 13, wherein the first body includes a first face and the second body includes a second face, and in the first configuration, the first face and the second face are coplanar.

23. An apparatus, comprising:

a body;

a first connector extending from the body, the first connector having a first side and a second side and including a first engagement feature on the first side of the first connector and a first flange on the second side of the first connector, the first flange projecting outwardly from the second side of the first connector; and a second connector extending from the body spaced apart from the first connector, the second connector having a first side and a second side and including a second engagement feature on the first side of the second connector, the first side of the second connector facing the second side of the first connector.

24. The apparatus of claim 23, wherein the first engagement feature is one of a protrusion and a recess and the second engagement feature is one of a recess and a protrusion.

25. The apparatus of claim 23, wherein the second side of the second connector is a continuous surface.

26. An apparatus, comprising:

a body;

a first connector extending from the body, the first connector having a first side and a second side and including a first engagement feature on the first side of the first connector and a first flange on the second side of the first connector; and a second connector extending from the body spaced apart from the first connector, the second connector having a first side and a second side and including a second engagement feature on the first side of the second connector and a second flange on the second side of the second connector, the first side of the first connector facing the second side of the second connector, the first connector and the second connector extending a first distance from the body, the body being on a first side of a plane defined through the first connector and the second connector, the plane being perpendicular to the body, at a second distance from the body, the first flange and the second flange positioned on a second side of the plane.

27. The apparatus of claim 26, wherein the first engagement feature is one of a protrusion or a recess and the second engagement feature is one of a recess or a protrusion.

28. The apparatus of claim 27, wherein the recess extends to an edge of the first connector or the second connector.

* * * * *